US007456808B1

(12) United States Patent
Wedding et al.

(10) Patent No.: US 7,456,808 B1
(45) Date of Patent: Nov. 25, 2008

(54) IMAGES ON A DISPLAY

(75) Inventors: Carol Ann Wedding, Toledo, OH (US); Jeffrey W. Guy, Toledo, OH (US)

(73) Assignee: Imaging Systems Technology, Toledo, OH (US)

( * ) Notice: Subject to any disclaimer, the term of this patent is extended or adjusted under 35 U.S.C. 154(b) by 877 days.

(21) Appl. No.: 10/768,097

(22) Filed: Feb. 2, 2004

Related U.S. Application Data

(63) Continuation-in-part of application No. 09/878,953, filed on Jun. 13, 2001, which is a continuation-in-part of application No. 09/774,055, filed on Jan. 31, 2001, which is a continuation-in-part of application No. 09/643,843, filed on Aug. 23, 2000, which is a continuation-in-part of application No. 09/556,337, filed on Apr. 24, 2000.

(60) Provisional application No. 60/446,243, filed on Feb. 11, 2003, provisional application No. 60/444,662, filed on Feb. 4, 2003, provisional application No. 60/131,177, filed on Apr. 26, 1999.

(51) Int. Cl.
*G09G 3/28* (2006.01)

(52) U.S. Cl. ..... 345/63; 345/60; 345/61; 345/62; 345/72

(58) Field of Classification Search ..... 345/60–72
See application file for complete search history.

(56) References Cited

U.S. PATENT DOCUMENTS 3,499,167 A 3/1970 Baker et al.
3,559,190 A 1/1971 Bitzer et al.
3,603,836 A 9/1971 Grier
3,801,861 A 4/1974 Petty et al.
3,803,449 A 4/1974 Schmersal
4,063,131 A 12/1977 Miller
4,087,805 A 5/1978 Miller
4,087,807 A 5/1978 Miavecz (Continued)

FOREIGN PATENT DOCUMENTS

EP 1 020 838 A1 7/2000

(Continued)

OTHER PUBLICATIONS

J. Ryeom et al., "High-Luminance and High-Contrast HDTV PDP with Overlapping Driving Scheme", pp. 743-746, *Proceedings of the Sixth International Display Workshops*, IDW 99, Dec. 1-3, 1999, Sendai, Japan.

(Continued)

*Primary Examiner*—Richard Hjerpe
*Assistant Examiner*—Leonid Shapiro
(74) *Attorney, Agent, or Firm*—Donald K. Wedding

(57) ABSTRACT

There is disclosed visual artifact reduction methods for a display comprising the use of gamma corrections, error diffusion, dithering, and/or center of light. The invention is described with reference to an AC gas discharge display (PDP), but may be practiced with other display technologies. The methods of this invention are disclosed for use with a number of PDP structures and PDP electronic addressing architectures including ADS, SAS, and ALIS. In one preferred embodiment, a center of light timing method is used to reduce artifacts between different sections of a PDP being addressed with SAS architecture.

18 Claims, 21 Drawing Sheets

U.S. PATENT DOCUMENTS

| | | | |
|---|---|---|---|
| 4,126,807 | A | 11/1978 | Wedding et al. |
| 4,126,809 | A | 11/1978 | Wedding et al. |
| 4,233,623 | A | 11/1980 | Pavliscak |
| 4,320,418 | A | 3/1982 | Pavliscak |
| 4,494,038 | A | 1/1985 | Wedding et al. |
| 4,611,203 | A | 9/1986 | Criscimagna et al. |
| 4,683,470 | A | 7/1987 | Criscimagna et al. |
| 5,410,219 | A | 4/1995 | Takei et al. |
| 5,436,634 | A | 7/1995 | Kanazawa |
| 5,446,344 | A | 8/1995 | Kanazawa |
| 5,541,618 | A | 7/1996 | Shinoda |
| 5,661,500 | A | 8/1997 | Shinoda et al. |
| 5,674,553 | A | 10/1997 | Shinoda et al. |
| 5,724,054 | A | 3/1998 | Shinoda |
| 5,736,815 | A | 4/1998 | Amemiya |
| 5,745,086 | A | 4/1998 | Weber |
| 5,793,158 | A | 8/1998 | Wedding, Sr. |
| 5,828,356 | A | 10/1998 | Stoller |
| 5,903,245 | A | 5/1999 | Shimizu et al. |
| 5,914,563 | A | 6/1999 | Lee et al. |
| 6,034,657 | A | 3/2000 | Tokunaga et al. |
| 6,052,101 | A | 4/2000 | Moon |
| 6,088,009 | A | 7/2000 | Moon |
| 6,097,358 | A | 8/2000 | Hirakawa et al. |
| 6,198,476 | B1 | 3/2001 | Hong et al. |
| 6,208,081 | B1 | 3/2001 | Eo et al. |
| 6,252,574 | B1 | 6/2001 | Hosoi et al. |
| 6,262,699 | B1 | 7/2001 | Suzuki et al. |
| 6,288,693 | B1 | 9/2001 | Song et al. |
| 6,340,960 | B1 | 1/2002 | Song et al. |
| 6,344,841 | B1 | 2/2002 | Moon |
| 6,362,800 | B1 | 3/2002 | Moon |
| 6,384,802 | B1 | 5/2002 | Moon |
| 6,433,763 | B1 | 8/2002 | Lim et al. |
| 6,466,187 | B1 | 10/2002 | Moon |
| 6,492,776 | B2 | 12/2002 | Rutherford |
| 6,646,625 | B1 * | 11/2003 | Shigeta et al. ..... 345/63 |
| 6,864,631 | B1 | 3/2005 | Wedding |
| 6,985,125 | B2 * | 1/2006 | Velayudhan et al. ..... 345/60 |
| 7,078,865 | B2 * | 7/2006 | Sano et al. ..... 315/169.3 |
| 7,122,961 | B1 | 10/2006 | Wedding |
| 7,157,854 | B1 | 1/2007 | Wedding |
| 7,176,628 | B1 | 2/2007 | Wedding |
| 7,247,989 | B1 | 7/2007 | Wedding |
| 7,307,602 | B1 | 12/2007 | Wedding et al. |
| 7,375,342 | B1 | 5/2008 | Wedding |
| 2002/0135548 | A1 | 9/2002 | Moon |
| 2002/0175906 | A1 | 11/2002 | Moon |

FOREIGN PATENT DOCUMENTS

| | | |
|---|---|---|
| WO | WO 00/30065 | 5/2000 |

OTHER PUBLICATIONS

Kanazawa et al., *1999Digest of the Society for Information Display*, pp. 154-157.

Tokunaga et al., "Development of New Driving Method for AC-PDPs", *Pioneer Proceedings of the Sixth International Display Workshops*, IDW 99, pp. 787-790, Dec. 1-3, 1999, Sendai, Japan.

* cited by examiner

| | Field | | | | | | | | | | |
|---|---|---|---|---|---|---|---|---|---|---|---|
| Sustains per subfield | 1 | 2 | 5 | 10 | 18 | 28 | 42 | 60 | 83 | 111 | |
| Number of Combinations | | | | | | | | | | | Output luminance |
| 0 | | | | | | | | | | | |
| 1 | 1 | | | | | | | | | | 1 |
| 2 | 1 | 2 | | | | | | | | | 3 |
| 3 | 1 | 2 | 5 | | | | | | | | 8 |
| 4 | 1 | 2 | 5 | 10 | | | | | | | 18 |
| 5 | 1 | 2 | 5 | 10 | 18 | | | | | | 36 |
| 6 | 1 | 2 | 5 | 10 | 18 | 28 | | | | | 64 |
| 7 | 1 | 2 | 5 | 10 | 18 | 28 | 42 | | | | 106 |
| 8 | 1 | 2 | 5 | 10 | 18 | 28 | 42 | 60 | | | 166 |
| 9 | 1 | 2 | 5 | 10 | 18 | 28 | 42 | 60 | 83 | | 249 |
| 10 | 1 | 2 | 5 | 10 | 18 | 28 | 42 | 60 | 83 | 111 | 360 |

Figure 2

$$E_C = K_{NW}*E_{NW} + K_N*E_N + K_{NE}*E_{NE} + K_W*E_W + K_C*LSB$$

Frame 1

| | |
|---|---|
| 1 | 2 |
| 3 | 4 |

Frame 2

| | |
|---|---|
| 2 | 1 |
| 4 | 3 |

Frame 3

| | |
|---|---|
| 4 | 3 |
| 2 | 1 |

Frame 4

| | |
|---|---|
| 2 | 1 |
| 4 | 3 |

Repeat Frame 1

Figure 9a

Pixel Turn-On Order, Low Luminace Input

Frame 0

| | | | |
|---|---|---|---|
| 1 | 9 | 3 | 11 |
| 15 | 7 | 13 | 5 |
| 3 | 11 | 1 | 9 |
| 13 | 5 | 15 | 7 |

Frame 1

| | | | |
|---|---|---|---|
| 6 | 14 | 8 | 16 |
| 12 | 4 | 10 | 2 |
| 8 | 16 | 6 | 14 |
| 10 | 2 | 12 | 4 |

Frame 2

| | | | |
|---|---|---|---|
| 3 | 11 | 1 | 9 |
| 13 | 5 | 15 | 7 |
| 1 | 9 | 3 | 11 |
| 15 | 7 | 13 | 5 |

Frame 3

| | | | |
|---|---|---|---|
| 8 | 16 | 6 | 14 |
| 10 | 2 | 12 | 4 |
| 6 | 14 | 8 | 16 |
| 12 | 4 | 10 | 2 |

Figure 9b

Pixel Turn-On Order, High Input Luminance

Frame 0

| | | | |
|---|---|---|---|
| 1 | 14 | 2 | 13 |
| 16 | 3 | 15 | 4 |
| 8 | 11 | 7 | 12 |
| 9 | 6 | 10 | 5 |

Frame 1

| | | | |
|---|---|---|---|
| 7 | 12 | 8 | 11 |
| 10 | 5 | 9 | 6 |
| 2 | 13 | 1 | 14 |
| 15 | 4 | 16 | 3 |

Frame 2

| | | | |
|---|---|---|---|
| 1 | 14 | 2 | 13 |
| 16 | 3 | 15 | 4 |
| 8 | 11 | 7 | 12 |
| 9 | 6 | 10 | 5 |

Frame 3

| | | | |
|---|---|---|---|
| 7 | 12 | 8 | 11 |
| 10 | 5 | 9 | 6 |
| 2 | 13 | 1 | 14 |
| 15 | 4 | 16 | 3 |

Figure 9c

Pixel Turn-On Order, Low Input Luminace

Frame 0

| | | | |
|---|---|---|---|
| 8 | 3 | 6 | 4 |
| 1 | 5 | 2 | 7 |
| 6 | 4 | 8 | 3 |
| 2 | 7 | 1 | 5 |

Frame 1

| | | | |
|---|---|---|---|
| 5 | 1 | 8 | 4 |
| 3 | 6 | 2 | 7 |
| 8 | 4 | 5 | 1 |
| 2 | 7 | 3 | 6 |

Frame 2

| | | | |
|---|---|---|---|
| 6 | 4 | 8 | 3 |
| 2 | 7 | 1 | 5 |
| 8 | 3 | 6 | 4 |
| 1 | 5 | 2 | 7 |

Frame 3

| | | | |
|---|---|---|---|
| 8 | 4 | 5 | 1 |
| 2 | 7 | 3 | 6 |
| 5 | 1 | 8 | 4 |
| 3 | 6 | 2 | 7 |

Figure 9d

Pixel Turn-On Order, High Input Luminace

Frame 0

| | | | |
|---|---|---|---|
| 2 | 8 | 1 | 7 |
| 6 | 4 | 5 | 3 |
| 1 | 7 | 2 | 8 |
| 5 | 3 | 6 | 4 |

Frame 1

| | | | |
|---|---|---|---|
| 1 | 7 | 2 | 8 |
| 5 | 3 | 6 | 4 |
| 2 | 8 | 1 | 7 |
| 6 | 4 | 5 | 3 |

Frame 2

| | | | |
|---|---|---|---|
| 1 | 7 | 2 | 8 |
| 5 | 3 | 6 | 4 |
| 2 | 8 | 1 | 7 |
| 6 | 4 | 5 | 3 |

Frame 3

| | | | |
|---|---|---|---|
| 2 | 8 | 1 | 7 |
| 6 | 4 | 5 | 3 |
| 1 | 7 | 2 | 8 |
| 5 | 3 | 6 | 4 |

Figure 9e

1 SUSTAIN PHASE
2 PRIMING PHASE FOR RAMP RESET
3 UP RAMP RESET
4 K- IDLE TIME BEFORE NEGATIVE RAMP RESET
DOWN RAMP RESET
I- IDLE TIME BEFORE ADDRESSING
5 ADDRESSING
J- IDLE TIME BEFORE SUSTAINING
6 SUSTAIN PHASE

IMAGES ON A DISPLAY

RELATED APPLICATIONS

Priority is claimed under 35 USC 119(e) for Provisional Patent Applications 60/444,662, filed Feb. 4, 2003 and Ser. No. 60/446,243, filed Feb. 11, 2003. This application is also a continuation-in-part under 35 USC 120 of co-pending U.S. patent application Ser. No. 09/878,953 filed Jun. 13, 2001, which is a continuation-in-part under 35 USC 120 of U.S. patent application Ser. No. 09/774,055 filed Jan. 31, 2001 which is a continuation-in-part under 35 USC 120 of U.S. patent application Ser. No. 09/643,843 filed Aug. 23, 2000 which is a continuation-in-part under 35 USC 120 of U.S. patent application Ser. No. 09/556,337 filed Apr. 24, 2000 which claims priority under 35 USC 119(e) of Provisional Application 60/131,177 filed Apr. 26, 1999.

STATEMENT OF FEDERALLY SPONSORED RESEARCH/DEVELOPMENT

None

INTRODUCTION

The invention relates to digital signal processing of a video image for improved picture quality on a display. This invention particularly relates to the reduction of static and dynamic visual artifacts and anomalies such as false contour on a display Static false contour is typically defined as the visual artifact that occurs on a still frame when pixels in close proximity have similar values expressed by opposite or very different subfield weighting. Dynamic false contour is typically defined as the visual artifact that occurs in a moving image when a pixel changes from its current value to a close value expressed by a subfield weighting that is opposite or significantly different from the original value. Dynamic false contour is a motion artifact.

BACKGROUND

This invention is described herein with reference to an AC gas discharge plasma display panel (PDP). However, this invention may also be practiced with other display technologies including other flat panel displays and projection displays. Both passive and matrix displays may be used including passive matrix and active matrix displays.

Such other display technologies include DC gas discharge (plasma) displays, electroluminescent displays (ELD), liquid crystal displays (LCD) including active matrix or thin film transistor LCD, passive LCD, light-emitting diode displays (LED), ferroelectric liquid crystal (FLC) displays, organic electroluminescent (OEL) displays, and organic light emitting diode (OLED) displays.

OLED is also called organic light emitting display. OLED is divided into molecular electroluminescent (EL) and polymer EL. Molecular OLED is disclosed in the prior art by Eastman Kodak, Pioneer of Japan, and Sanyo of Japan. Polymer OLED is disclosed by Philips of Holland, Dow Chemical, UNIAX, and Cambridge University (UK). OLED may be passive matrix or active matrix.

Other display technologies also include projection displays such as digital micromirror device (DMD) arrays are disclosed in the prior art by Texas Instruments. Liquid Crystal on Silicon (LCOS) displays are contemplated. This invention is especially suitable with displays which use time multiplexing gray scale.

A plasma display panel (PDP) consists of a grid of addressable cell elements, also called pixels or subpixels. As used herein, pixel means subpixel, cell, or subcell and cell means subcell, pixel, or subpixel. A cell or pixel element is defined by the cross point of a row electrode and a column electrode for a columnar discharge display or a column electrode and two row electrodes for a surface discharge display. In the case of a surface discharge display, a pair of row electrodes (X and Y) are termed scan electrode and sustain electrode. In both columnar discharge and surface discharge PDP displays, the electrode are coated with dielectric. As part of each cell element, there is an ionizable gas. When the appropriate voltages are applied to the row and column electrodes, the ionizable gas discharges. The discharge may produce visible light or UV light that excites a phosphor. In either case, the cell only has two states, a "light-emitting" state and a "non-light-emitting" state. In most applications, gray scale is achieved through time multiplexing. In a single video frame, the number of times cells are put into the discharge state is proportional to the input luminance defined by the input video signal. The input luminescence is the digitally created video input to a PDP from a video receiver or other source.

A single video field is divided in time into 'n' number of weighted subfields, each weighted by a unique number of discharge pulses (or sustain pulses). A subfield consists of an addressing period in which cells are selected to be "light emitting" or "non light emitting" and a sustain period in which cells that have been selected to be "light-emitting" produce light proportional to the number of sustains in the subfield. In practice the number of subfields (n) in a field is limited by various timing constraints including addressing time and sustain time. These in turn may be dependent on various physical attributes of the plasma display panel, including display structure, display resolution, gas composition, gas pressure, and the number of rows to address.

Artifact Reduction

Displays including PDP represent gray levels by techniques that cause undesirable visual artifacts such as false contours including flicker and noise. Various methods have been proposed in the prior art to reduce static and dynamic false contours in displays including PDP. These methods include spatial multiplexing, frame multiplexing, binary weighting of subfields, non-binary weighting of subfields, control of light pulse timing, error diffusion, gamma correction, equalizing pulse, compression of light emission time, and optimization of subfield pattern. Optimization of subfield pattern includes optimizing the number of subfields in a frame and optimizing the sustain ratios from subfield to subfield.

Pioneer of Tokyo, Japan has disclosed a technique called CLEAR for the reduction of false contour and related problems. CLEAR stands for High-Contrast, Low Energy Address and Reduction of False Contour Sequence. See Development of New Driving Method for AC-PDPs by Tokunaga et al of Pioneer *Proceedings of the Sixth International Display Workshops*, IDW 99, pages 787-790, Dec. 1-3, 1999, Sendai, Japan. Also see European Patent Application EP 1 020 838 A1 published Jul. 19, 2000 by Tokunaga et al of Pioneer.

CLEAR is one example of a technique that combines multiple concepts of dither gray scale, error diffusion, gamma correction, and subfield weighting to produce a PDP with few visual artifacts. The present invention also combines multiple concepts to improve electronic addressing and reduce visual artifacts in a display device.

Pioneer Prior Art Disclosing Artifact Reduction

The following prior art is incorporated herein by reference.

U.S. Pat. No. 6,018,329 issued to Hiroshi Kida et al of Pioneer Electronic Corporation, Tokyo, Japan, U.S. Pat. No. 6,008,793 issued to Tetsuya Shigeta of Pioneer Electronic Corporation, Tokyo, Japan, US Patent Application Publication 2003/0006944 A1 by Takashi Iwami et al of Pioneer Corporation, Japan, European Patent application EP 1 022 714A2, by Tetsuya Shigeta et al of Pioneer Corp. Display, Yamanashi, Japan, published Jul. 26, 2000

European Patent Application EP 1 020 838 A1, by Tsutomu Tokunaga et al of Pioneer Corporation, Mejuro-ku, Tokyo, Japan, published Jul. 19, 2000, European Patent Application EP 0 720 139 A3, by Takashi Okano et al of Pioneer Electronic Corporation, Meguro-ku, Tokyo, Japan, published Jul. 30, 1997, Development of New Driving Method for AC-PDPs, High Contract, Low Energy Address and Reduction of False Contour Sequence "CLEAR," by T. Tokunaga et al of Pioneer Corporation, Yamanashi, Japan, IDW 99, Proceedings of The Sixth International Display Workshops, Sendai, Japan, pp. 787 to 790, Dec. 1-3, 1999, Improvement of Moving Video Image Quality on PDPs by Reducing the Dynamic False Contour by T. Shigata et al, SID 98 Digest, pp. 287-290 (1998).

SUMMARY OF THE INVENTION

In accordance with this invention, there is provided a method to achieve gray scale though time multiplexing and spatial multiplexing that reduces visual artifacts and provides high contrast at low brightness and luminance in a display such as a PDP.

This invention also comprises improvements in artifact reduction in a PDP or other display by means of gamma correction, error diffusion, and dithering.

This invention also comprises a center of light mass artifact reduction method and a unique drive method that provides for the addressing of a large number of rows without dual scan, without decreasing brightness, and without causing flicker.

BRIEF DESCRIPTION OF THE SEVERAL VIEWS OF THE DRAWING

FIG. 2 is an example of non-binary weighting in which a cell once being turned off stays off for the remainder of the frame.

FIG. 9*a* is a prior art dither table.

FIGS. 9*b*, 9*c*, 9*d*, 9*e* are dither tables in accordance with the practice of this invention.

DETAILED DESCRIPTION OF THE DRAWINGS AND INVENTIONS INCLUDING DISCLOSURE OF BEST MODES AND EMBODIMENTS

Figure 3:
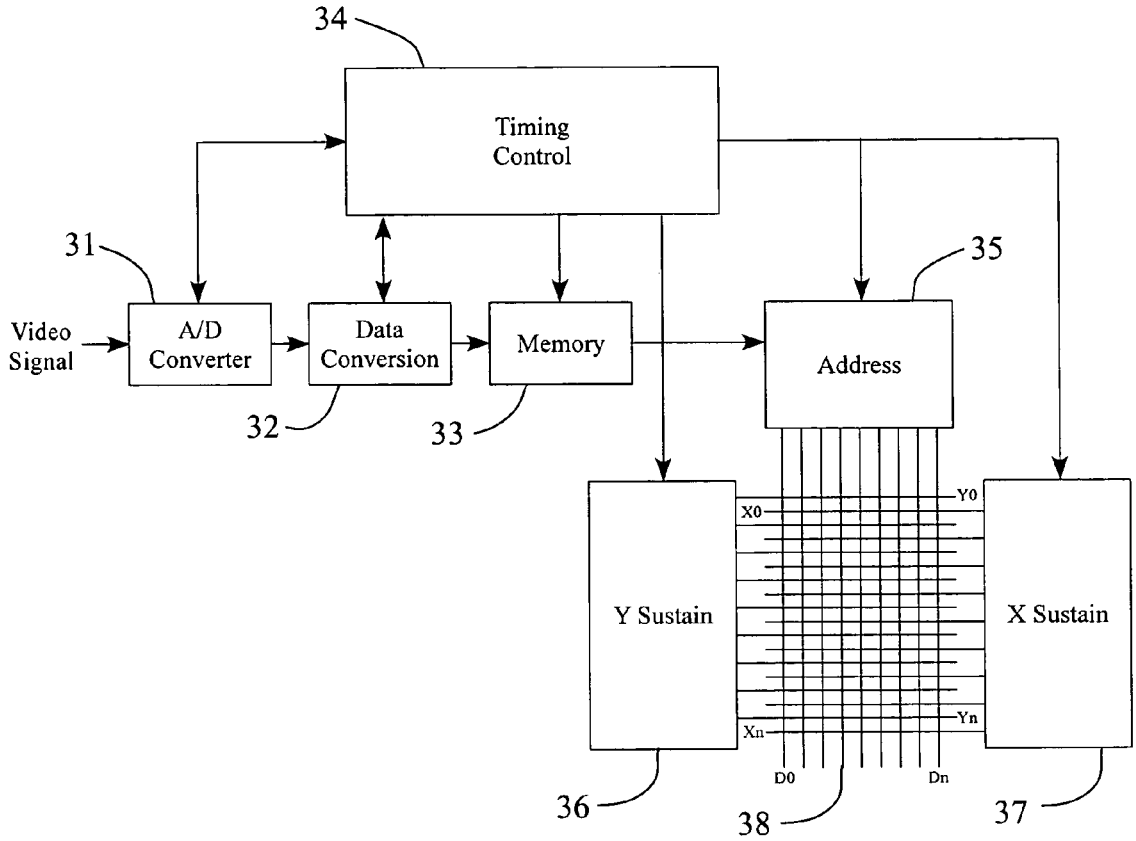
FIG. 3 is a block diagram of a surface discharge plasma display system with PDP and electronics.

FIG. 3 is a block diagram of a plasma display comprising a PDP with electronics. As can be seen a grid of addressable pixels 38 is formed by the intersection of row electrodes (X0 . . . Xn) and (Y0 . . . Yn) and column electrodes (D0 . . . Dn). An analog video signal is converted to a digital signal by the A/D (analog/digital) Converter 31. The digital signal is processed in Data Conversion 32 for storage in Memory 33. The Timing Control 34 controls the A/D Converter, Data Conversion, memory access, and waveform timing of the display. The Timing Control 34 also synchronizes the drive of the waveform with the input video signal. The drive waveform is a high voltage waveform generated by the Y sustain 36 and X sustain 37 in combination with the Addressing assembly 35.

Subfield Weighting

Figure 1:
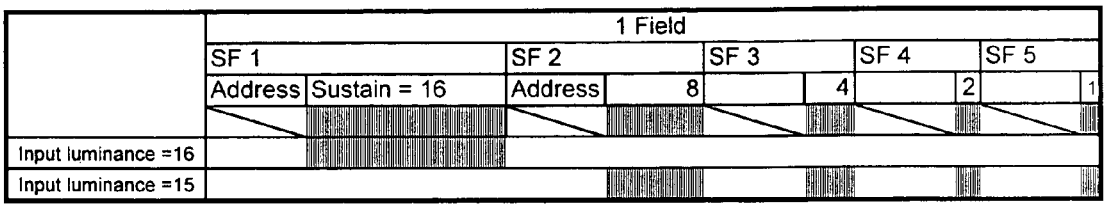
FIG. 1 presents a prior art format for implementing time multiplexed gray scale using a weighted binary method.

FIG. 1 illustrates time multiplexed gray scale with weighted binary using five subfields. In this case the ratio between the sustains for each subfield (SF) is as follows:

SF 1: 16

SF 2: 8

SF 3: 4

SF 4: 2

SF 5: 1

Thus for SF 1, the ratio of the number of sustains relative to the number of sustains in the four other SFs is 16:8:4:2:1. The input luminance is the digitally created video input to a PDP from a video receiver or other source. In the case where the input luminance of a cell is 16, the cell is put into the light emitting state during SF 1. When the input luminance of a cell is 15, it is put into the light emitting state in SF 2, 3, 4, and 5. In the above example of FIG. 1, 32 unique gray scale combinations are achieved with 5 subfields. When this method is employed, visual artifacts including false dynamic contour and motion artifact may be observed in the displayed video image. FIG. 1 specifically illustrates five subfields with a binary weighted ratio of sustains. By increasing the number of subfields the number of gray levels may be increased. When this gray scale method is employed, visual artifacts including false contour and motion artifact may be observed in the displayed video image.

To illustrate false contour in the example of FIG. 1, assume a single cell has an associated input luminance of 16 and its neighbor has an associated input luminance of 15. These neighbor cells are close in value but are represented by very different subfield weighting. In this example, 16 is represented by the cell being illuminated in the first subfield and off in subfields 2 through 5. In the example of 15, the cell is not illuminated in subfield 1 and it is illuminated in subfields 2 through 5. The large difference in subfield weighting may be disturbing to the eye.

The above was described with 5 subfield and 32 gray levels. Typically 256 gray levels are realized with 8 binary weighted subfields having sustain ratios as follows.

SF1: 128
SF2: 64
SF3: 32
SF4: 16
SF5: 8
SF6: 4
SF7: 2
SF8: 1

Non binary subfield weighting may also be used including:

SF1: 48
SF2: 35
SF3: 26
SF4: 19
SF5: 12
SF6: 8
SF7: 5
SF8: 3
SF9: 2
SF10: 1

This subfield weighting has the advantage of not allowing large changes in subfield weighting with small changes in input luminance. This type of subfield weighting helps to eliminate motion artifact and false contour. Further advantage may be obtained if a cell is turned 'on' only once in a frame, and left 'on' in proportion to its gray value rather than being turned 'on' and 'off' several times in a frame. This method is disclosed in U.S. Pat. No. 4,385,293 issued to Wisnieff of United Technologies Corp., of Hartford, Conn., and is included herein by reference.

FIG. 2 shows an example of a non-binary weighting of subfields in which a cell may be turned on a maximum of one time and turned off a maximum of one time in a given frame. The address timing has been omitted and only the number of sustains are shown for each subfield. The ratios of the number of sustains in each subfield are non-linear and perform a gamma correction to the input luminance.

In this method, if a cell is to be turned on, it is turned on in the first subfield. It stays on in proportion to the input luminance. Once a cell is turned off, it stays off for the remainder of the field. Thus for 10 subfields, only 11 unique grayscale values may be achieved. To achieve more perceived gray values with this method, it is necessary to spatially and temporally multiplex the image. This can be achieved with the circuit diagram in FIG. 4.

Figure 4:
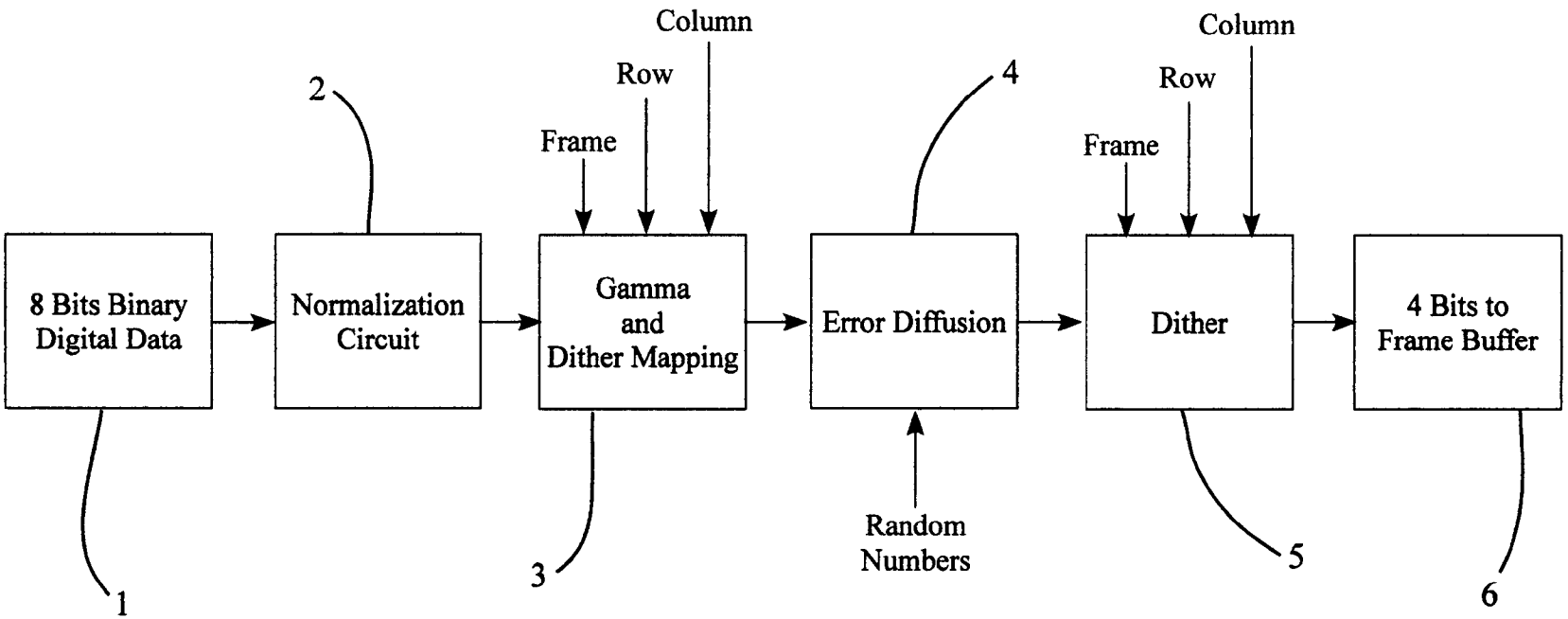
FIG. 4 is a block diagram of a method for reducing false contour using gamma corrections, error diffusion, and dithering.

FIG. 4 illustrates the conversion process with 8 bits binary input luminance using the subfield mapping of FIG. 2. The input luminance is not limited to 8 bits binary. The number of subfields is not limited to 10, and the number of sustains may be different than illustrated in each subfield.

Normalization Circuit

In FIG. 4 the input luminance consisting of 8 bits binary digital data 1 is sent to normalization step 2. Normalization is necessary to prevent rollover of higher values in subsequent additive steps of Error Diffusion 4 and Dithering 5.

In this example, if the input luminance ranges from 0 to 255 levels, realized in 8 binary weighted bits, the upper four bits, which can range from 0 to 15, must be remapped to range from 0 to 10. In this way each of the four upper bits can serve to select one of the eleven valid combinations allowed in FIG. 2.

The four lower bits are further processed to contribute the temporal and spatial multiplexing and thus increase the number of perceived gray levels. However, they are also mapped so that they do not contribute to rollover in subsequent steps.

FIG. 4 is a block diagram of a circuit for converting 8 bit input luminance data from a video source to produce gray scale with a non-binary weighted gamma and using spatial and time multiplexed dithering. Although the FIG. 4 illustration is shown with 8 bits input data, other input data are possible including but not limited to 6 bits and 10 bits.

Gamma

Pioneer discloses selecting between two gamma curves on alternate frames. Pioneer discloses normalizing and gamma correction of the input data. Pioneer further discloses examples of the shape of the gamma curves in FIGS. 11 and 12 of EP 1 022 714 A2 cited above and incorporated herein by reference.

In FIG. 4, after normalization, gamma correction is applied to the normalized data with gamma correction and dither mapping 3.

In accordance with this invention, unique gamma curves are applied to the normalized data based on spatial position, also known as dither mapping. A number of pixels are selectively grouped so as to act in concert and a different and unique gamma curve is applied to the input luminance of each pixel, the shape of each gamma curve being such that only a limited number of pixels change with incremental changes in luminance, while the other pixels in the group remain unchanged. By minimizing the number of pixels that change in a given area with incremental changes of input luminance, motion artifacts and false contour are reduced.

The gamma curves are shaped so as to prevent simultaneous changes in the grouped pixels when the input luminance increases from n to n+1 or decrease from n to n−1.

Figure 5A:
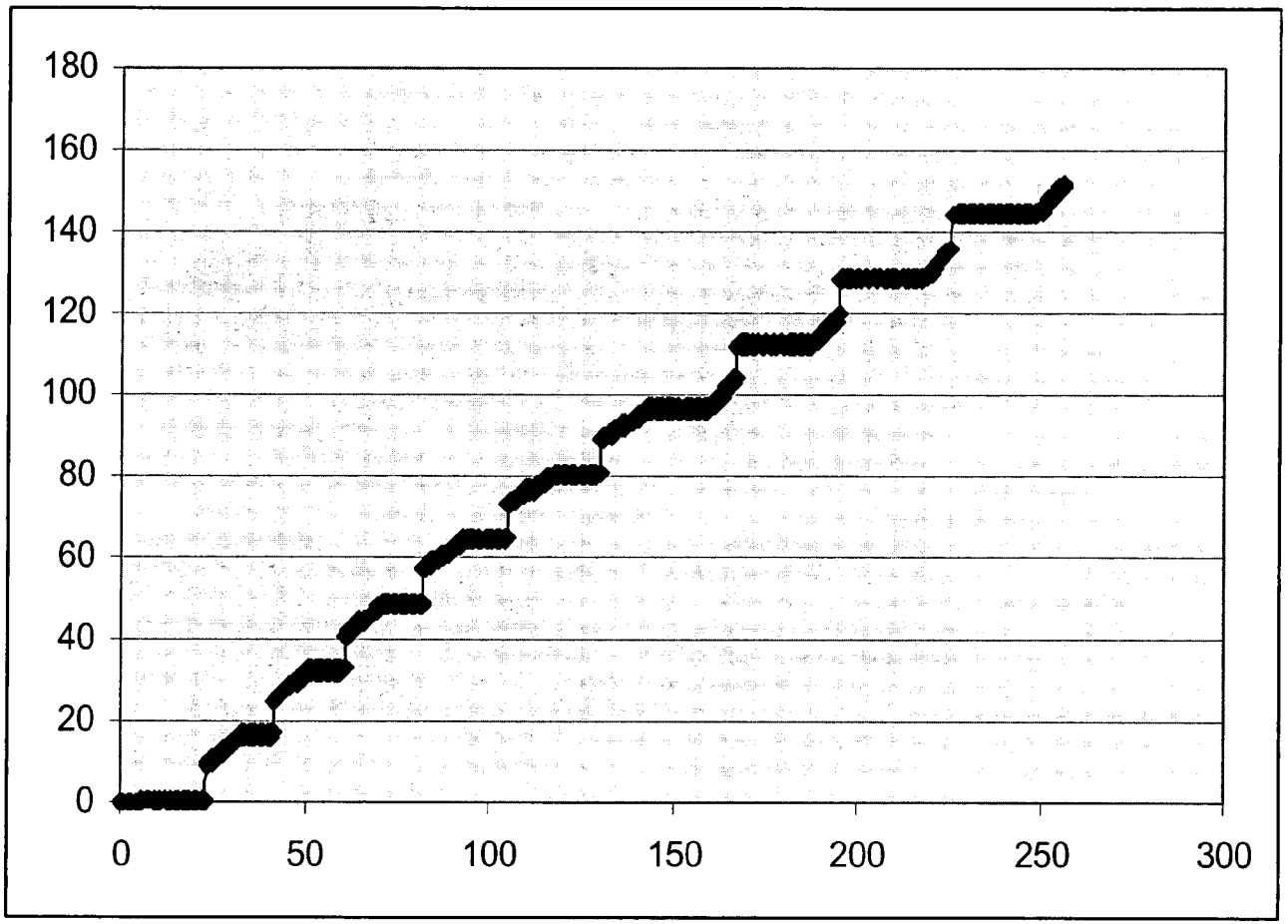
FIGS. 5*a*, 5*b*, 5*c*, 5*d*, and 5*e* are graphs of gamma curves
Figure 5B:
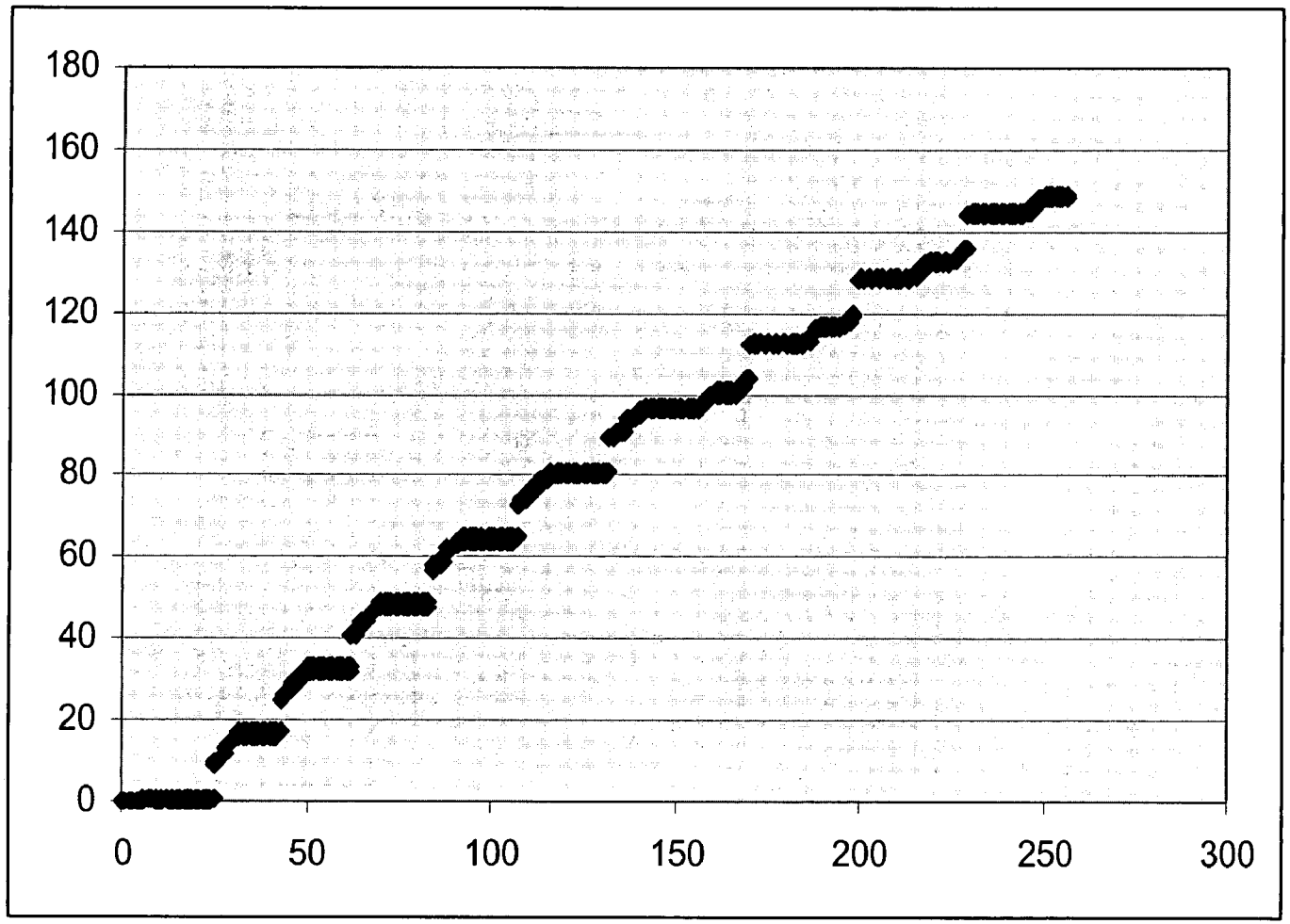
Figure 5C:
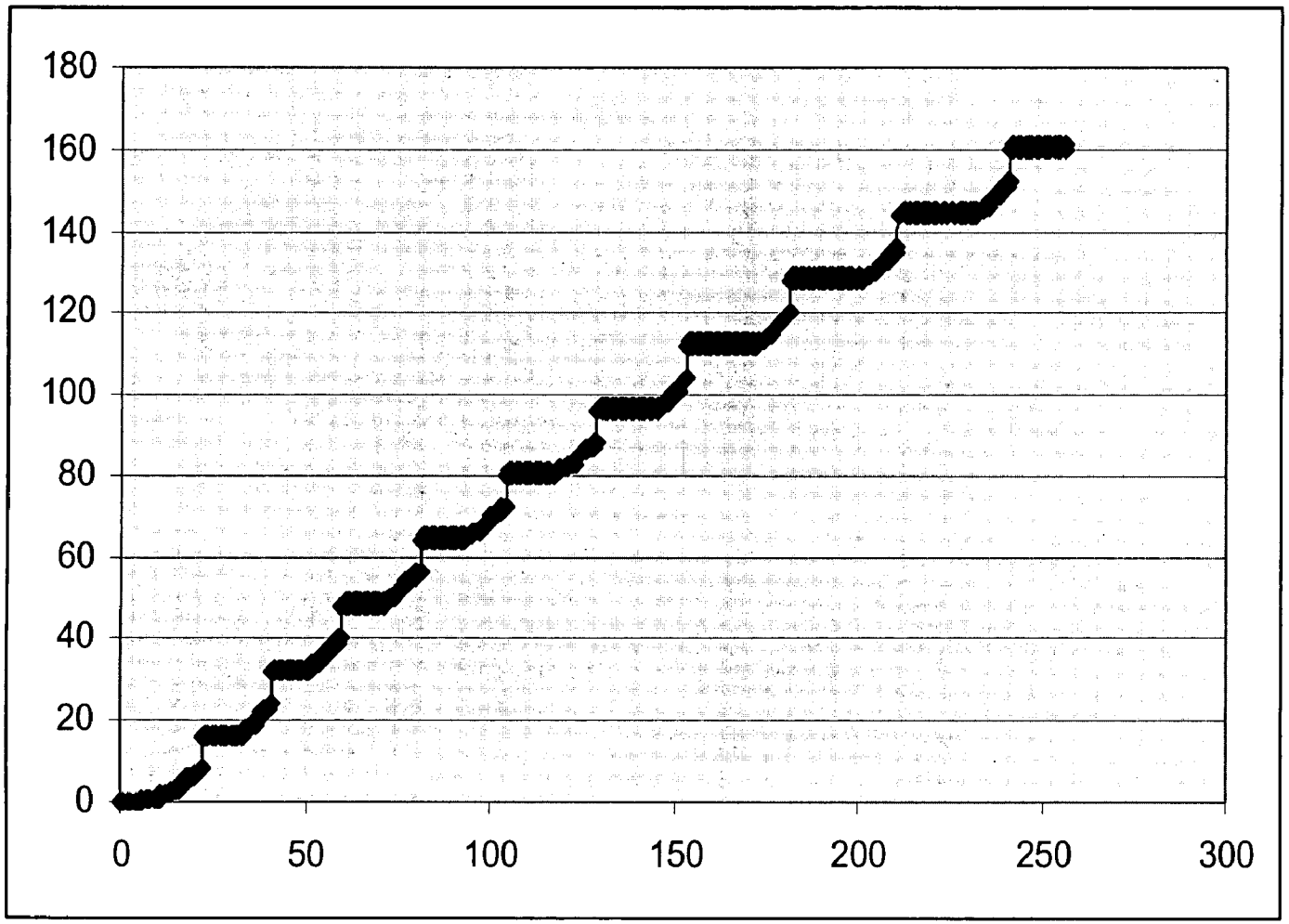
Figure 5D:
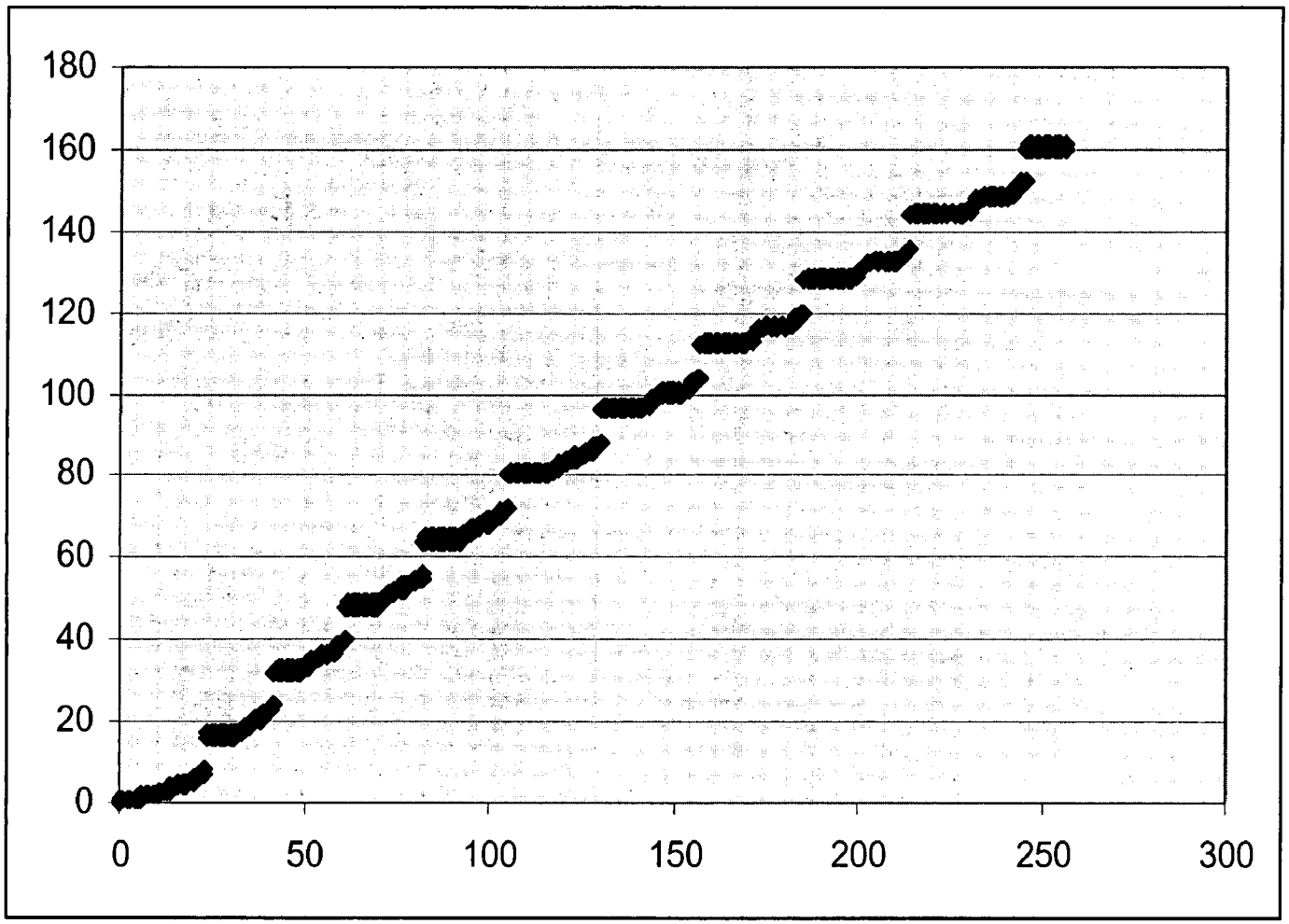
Figure 5E:
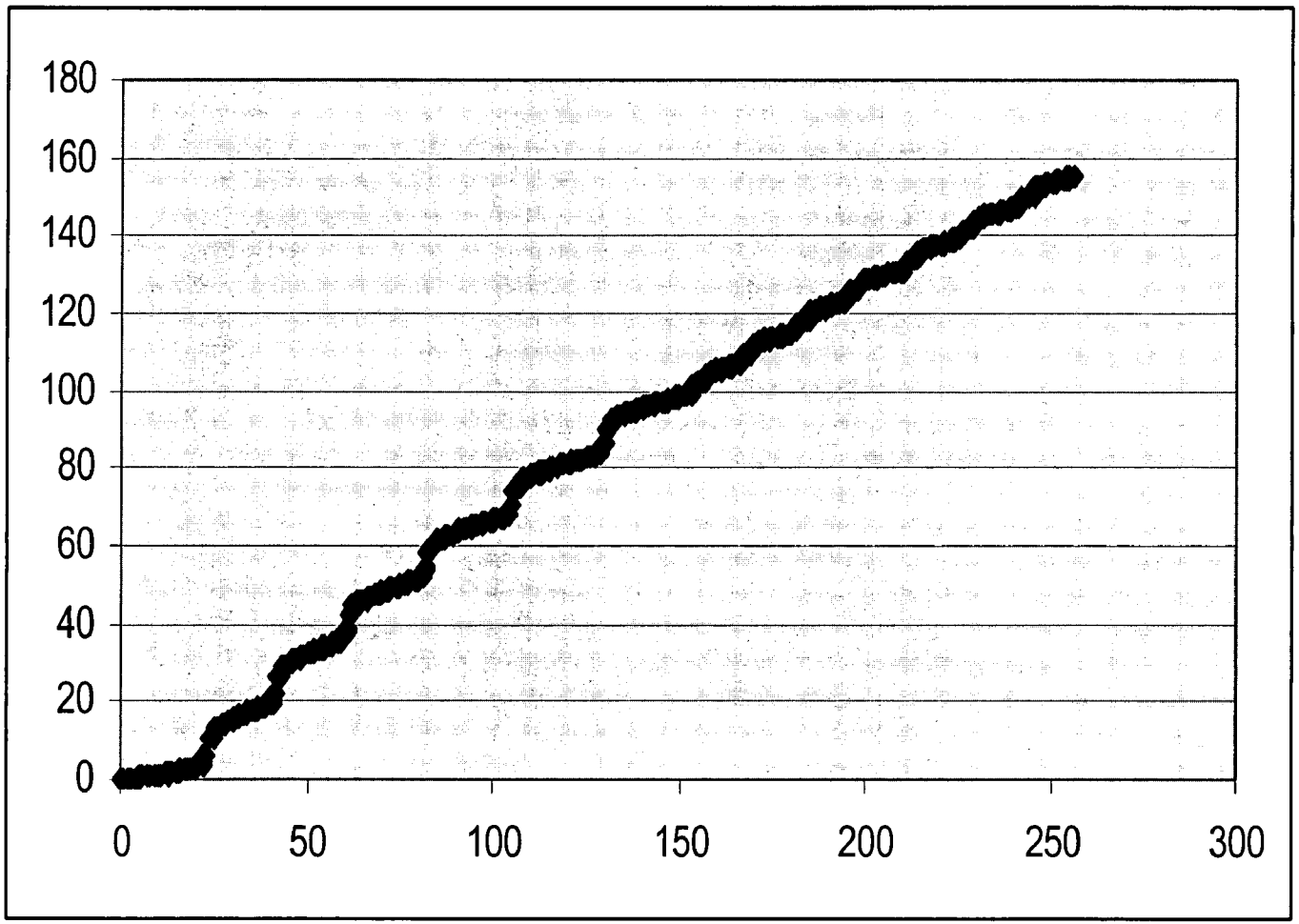

FIG. 5*a* through 5*d* illustrates the improved gamma mapping applied to the four pixel quadrant. Four "stair step" curves in FIG. 5*a* through 5*d* are averaged together resulting in the smooth curve of FIG. 5*e*. By disallowing changes in all four pixels simultaneously, motion artifacts such as false contour are greatly reduced.

The gamma correction methods of this invention may be used alone or in combination with one or more other artifact reduction methods including error diffusion, dithering, and center of light mass as described herein.

Error Diffusion

In a further embodiment of this invention, the gamma corrected data is further processed to realize more gray levels through error diffusion and dithering. Error diffusion is defined as a method of adding random noise to the input luminance data pixel by pixel as described herein. This method makes less obvious the patterns that will occur when spatial dithering is applied over an area.

Figure 6:
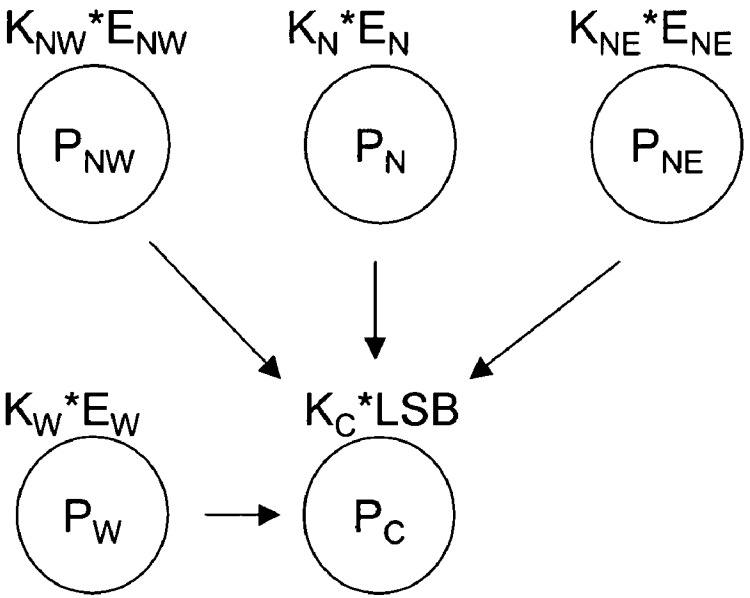
FIG. 6 illustrates the Floyd Steinberg method of error diffusion as applied to a plasma display system.

FIG. 6 illustrates the Floyd Steinberg method of error diffusion as has been disclosed in the prior art. In this method, so called error values are derived from the least significant bits of the gamma corrected input luminance data. In the illustration, two bits are used. However, one bit or three bits may be used.

FIG. 6 shows a center pixel $P_C$ with four neighbor pixels $P_W$, $P_{NW}$, $P_N$ and $P_{NE}$. $P_C$ has associated error term $E_C$.

Error term $E_C$ is derived from the error terms of the neighbor pixels, $E_W$, $E_{NW}$, $E_N$ and $E_{NE}$, which are multiplied by weighting factors $K_W$, $K_{NW}$, $K_N$ and $K_{NE}$. The LSB of the center pixel multiplied by a weighting factor is also used to derive the error term of the center pixel. This is shown below.

$$E_C=K_{NW}*E_{NW}+K_N*E_N+K_{NE}*E_{NE}+K_W*E_W+K_C*LSB$$

Ec is the error term of Pc. The two bit value of Ec is stored and used to calculate the error terms of the pixels to the East, Southeast, and South of $P_C$. Additionally, the carry bit of $E_C$ is added to the gamma corrected input luminance data.

To prevent the carry from producing a predictable pattern, the value of the coefficients may be changed from frame to frame.

For example

Frame 1: $K_{NW}=7/16$, $K_N=1/16$, $K_{NE}=5/16$, and $K_W=3/16$, and $K_C=1$

Frame 2: $K_{NW}=1/16$, $K_N=5/16$, $K_{NE}=3/16$, $K_W=7/16$, and $K_C=1$

Frame 3: $K_{NW}=5/16$, $K_N=3/16$, $K_{NE}=7/16$, $K_W=1/16$, and $K_C=1$

Frame 4: $K_{NW}=3/16$, $K_N=7/16$, $K_{NE}=1/16$, $K_W=5/16$, and $K_C=1$

In accordance with this invention, some of the $K_e \cdot E$ products of the Floyd Steinberg method are replaced with a randomly generated value to obtain $E_C$ for the pixel $P_C$.

$$E_C=\text{Random}[\max(LSB)\times(K_{NW}+K_N)\ldots 0]+K_{NE}\cdot E_{NE}+K_W\cdot E_W+K_C\cdot LSB$$

where max(LSB) equals the maximum value of the LSB. In the case where 2 LSB are used, the maximum value is 2. In the case where 3 LSB are used, the max(LSB) equals 8. The term Random [max(LSB)×($K_{NW}$+$K_N$) . . . 0] denotes a random number generated between max(LSB)×($K_{NW}$+$K_N$) and 0.

This randomization prevents predictable patterns and provides higher contrast even in a sparsely populated or at low luminance even in an almost dark PDP screen. The substitution of randomly generated values provides less complex data processing because some of the storage error value requirements are eliminated.

In one embodiment of this invention, the E-K products comprised of the lower two constants 1/16, and 3/16 are replaced with a random number. In this way only two neighbor pixels are considered to produce error diffusion instead of four neighbor pixels. The random value has the effect of allowing an occasional carry even if the neighbors provide 0 error input.

This invention is especially useful when input luminance data from an A/D source is provided two pixels at a time. In this case, the prior art would use a clock doubler to calculate the error value and the carry of a given pixel at the required rate. The randomization method of this invention allows the error value and carry of both pixels to be calculated simultaneously without the need to double the clock.

Figure 7:
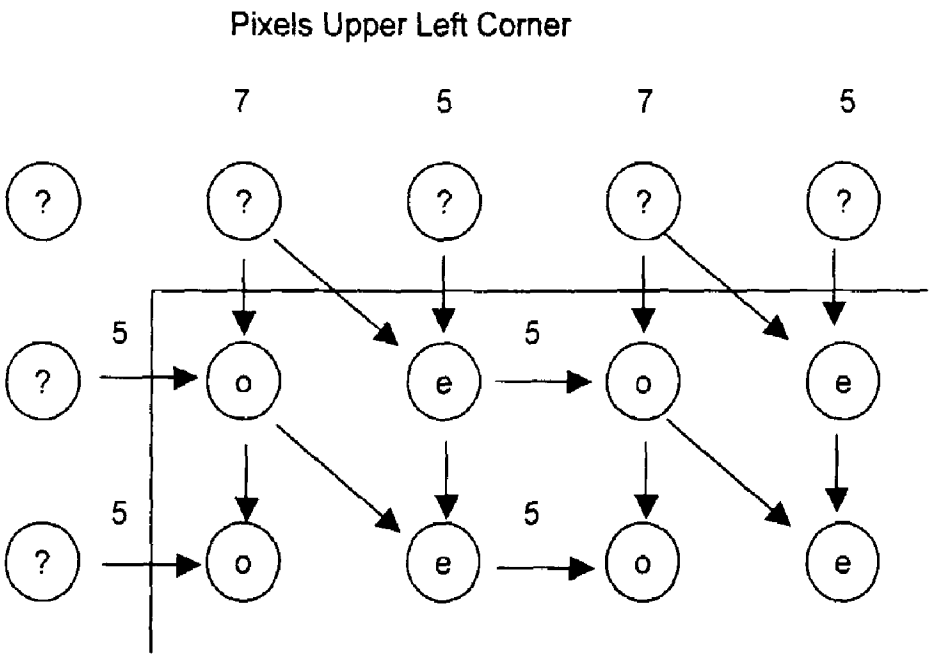
FIG. 7 illustrates an error diffusion method in accordance with this invention.

FIG. 7 shows an example how this method may be applied to input data of two pixels, odd and even, by eliminating some of the K·E products and replacing them with a random value. In this example the odd pixel (o) of the pair receives error data multiplied by a constant from the west neighbor and the north neighbor. This error data is added to a random number to produce an error value and carry for the first pixel. The even pixel (e) receives error data from the neighbor to the northwest and the neighbor to the north. This data is also multiplied by constants and added to a random number.

In this example, the constants used are 7/16 and 5/16 and the constants that are included in the random term are 1/16 and 3/16. Therefore, $$\text{Error(odd)}=[7\cdot E_N+5\cdot_{EW}+16\cdot LSB+\text{Random}(12\ldots 0)]/16$$

$$\text{Error(even)}=[7\cdot E_{NW}+5\cdot E_N+16\cdot LSB+\text{Random}(12\ldots 0)]/\mathbf{16}$$

Figure 8:
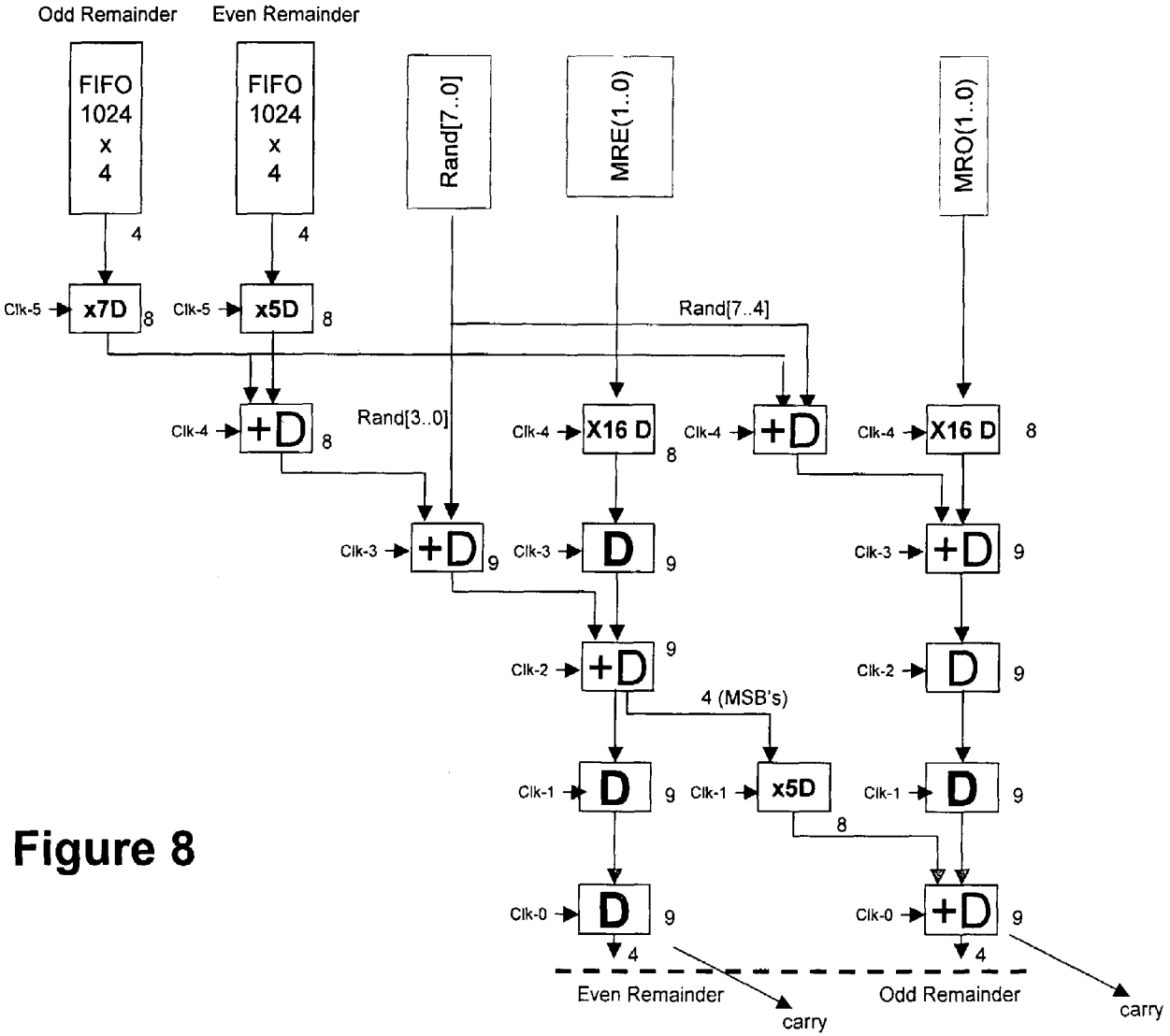
FIG. 8 is a block diagram of a circuit to practice error diffusion using random numbers in accordance with this invention.

FIG. 8 is a block diagram of a circuit to obtain error diffusion using random numbers. The diagram shows a process applied to a system in which two pixels are processed simultaneously.

In the implementation of the error diffusion method as shown in FIG. 8, the least significant bits of odd and even data are labeled MRE (1 . . . 0) and MRO(1 . . . 0). Rand[7 . . . 0] is a random value input to the equations. Odd Remainder and Even Remainder are the error diffusion values of the previous line which are stored in a FIFO. Collectively Rand[7 . . . 0], MRE(1 . . . 0), MRO(1 . . . 0), Odd Remainder, and Even Remainder are the input data. The input data are passed through successive registered states, "D", in which they are either summed or multiplied in accordance with the invention. This is done synchronous with the dot clock. The final stage results in an Even Remainder and an Odd Remainder which are fed back into the FIFOs. The carry value is summed with the most significant bits of odd and even data to provide the error diffusion.

In accordance with another embodiment of this invention, the randomization method may be used in combination with varying one or more of the coefficients K.

The error diffusion methods of this invention may be used alone or in combination with one or more other artifact reduction methods including gamma correction, dithering, and center of light mass as described herein.

Dither

The dither coefficients are added to the next least significant bits (the dither bits) along with the carry to produce the final value that is sent to the frame buffer for display on the screen. Pioneer has disclosed adding dither coefficients to a 2×2 quadrant of pixels. This method may be improved by using a larger dither matrix, such as a 4×4 matrix and optimizing the dither coefficients based on input luminance, and type of video input (eg moving or still image). By using a larger dither matrix, more apparent gray scales are achieved. The coefficients should be selected to evenly distribute the grayscale dither pattern over the area matrix. Dither coefficients should also be selected in such a way as to limit the carry value added to the upper bits, when summed with the dither bits of the input luminance and the carry bit from the error diffusion. In this way the value of the upper bits of a single pixel is limited to toggling between n and n+1. When the same input luminance is applied to the 4×4 matrix, all the values of the upper bits of the pixels of that matrix will be at a value of n or n+1. In other words a single input luminance will be manifested as maximum of two values on the screen. The percentage of the two values will determine the perceived gray level. If a matrix of 16 has all n values it will be 1/16 dimmer then a matrix that averages n in 15 out of 16 position and n+1 in 1 out of 16 positions.

By limiting the output to n and n+1 for a given input luminance, the image will be improved because of less flicker.

For example FIG. 9*b* and FIG. 9*c* illustrate a dither table for use with a computer-generated image, which is mostly still. The tables show the turn on order of a matrix of pixels as the input luminance increase. A '1' value in the matrix indicates that pixel will change to the next largest value with the minimum increase to the input luminance. A value of '16' in the matrix indicates that the input luminance must increase a maximum value from the starting point of n before it will change to the next value. Thus the turn on order is inversely proportional to the dither coefficients.

In this example, 10 subfields are used. FIG. 9*b* illustrates a dither table to be used with low input luminance. FIG. 9*c* illustrates a dither table to be used with high input luminance. In an image which is mostly moving, the dither tables of FIG. 9*d* and FIG. 9*e* may be used. FIG. 9*d* is for low input luminance and FIG. 9*e* is for high input luminance. In both cases the dither matrix changes from frame to frame.

Figure 9F:
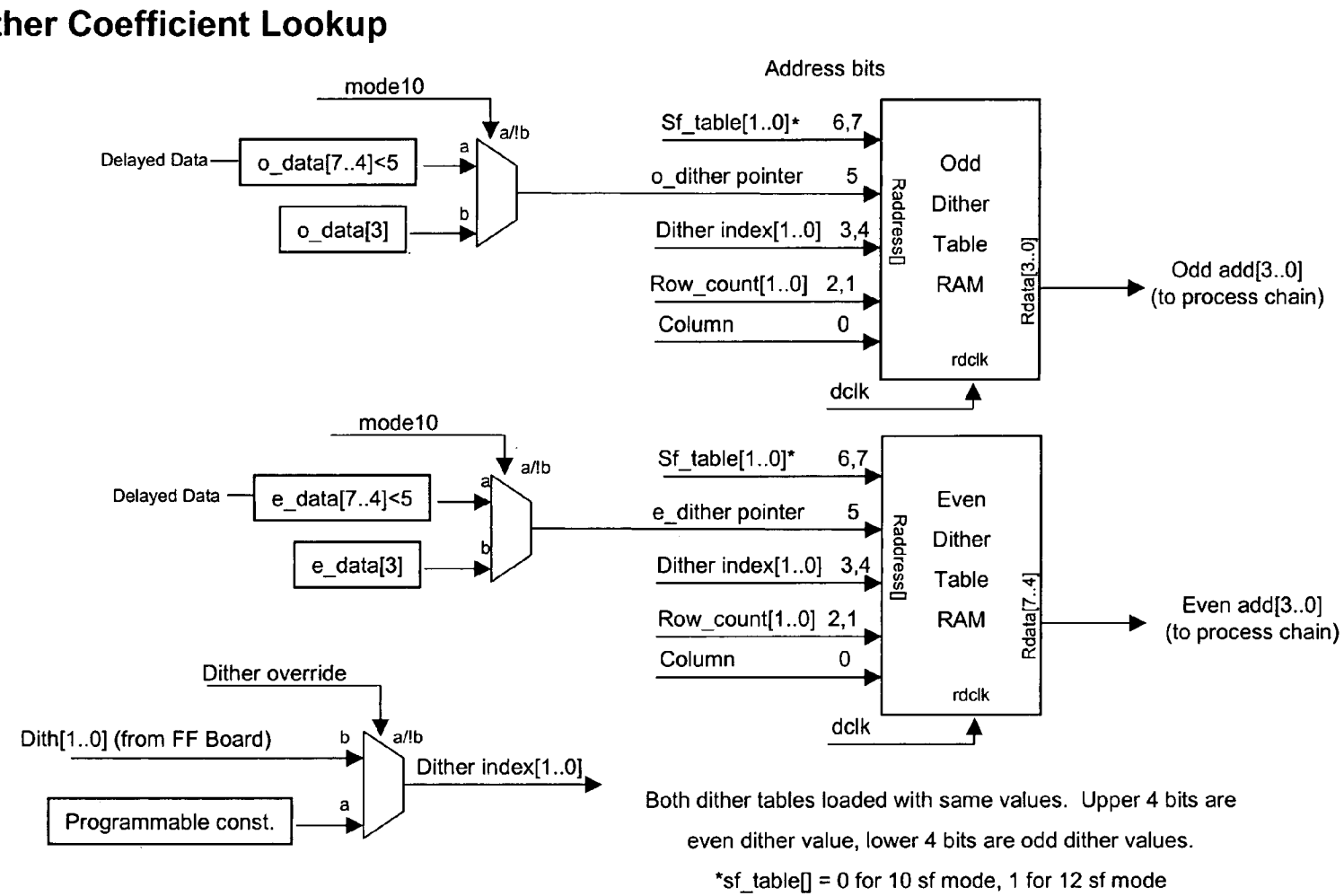
FIG. 9*f* is a block diagram of a circuit to implement the dither tables of 9*b*, 9*c*, 9*d*, and 9*e*.

FIG. 9*f* is a block diagram of the dither processing circuit. The dither table is selected based on luminance input, spatially by row and column input, and in time by frame input. FIG. 9*f* illustrates the implementation of the dither lookup table. Odd Dither Table RAM and Even Dither Table Ram are lookup tables that output data in accordance with the FIGS. 9*b,c,d,e* depending on value of the input luminance which is labeled Delayed Data; the mode of the image (still or moving); the number of subfields (sf) used to represent the image; and the row, column; and the frame which is labeled dither index.

The dithering methods of this invention may be used alone or in combination with one or more other artifact reduction methods including gamma correction, error diffusion, and center of light mass as described herein.

Center of Light Method

The center of light method may also be known as the center of light gravity or center of mass method wherein the eye responds to a concentration of light and its relative position from other concentrations of light. PCT Publication WO 2004/003881 by Weitbruch et al of Thomson, incorporated herein by reference, defines the temporal center of gravity of light as applied to a PDP. In a PDP these are light pulses produced by the sustain pulses. Different luminance inputs, which are close in value, produce artifacts in adjacent pixels or in pixels as they change between these values. For example, in a plasma display using binary weighting of 8 subfields the values of 127 and 128 are close in value but have significantly different centers of light gravity or mass because of timing differences in the sustain pulses. This is apparent to the viewer and the problem is manifested in motion artifacts such as flicker or false contour. To reduce artifacts, the timing of the light pulse is controlled such that the center of light gravity or mass increases monotonously with increasing input luminance. This may be done by adjusting the timing of subfields as well as the weighting of subfields.

The center of light method of this invention may be used alone or in combination with one or more artifact reduction methods including gamma correction, error diffusion, and dithering as described herein.

Center of Light Method and SAS

There are a number of architectures and methods for addressing a plasma display. One preferred practice and embodiment of this invention comprises addressing one display section of a PDP while another section of the PDP is being simultaneously sustained. This architecture is called Simultaneous Address and Sustain (SAS) and is described in further detail below. In a preferred embodiment of this invention, the center of light mass invention is used with SAS architecture.

SAS offers a unique electronic architecture which is different from prior art columnar discharge and surface discharge electronics architectures such as ADS, AWD, and MASS discussed below. SAS offers important advantages over other electronic architecture.

An important feature and advantage of SAS is that it allows selectively addressing of one section of a surface discharge PDP with selective write and/or selective erase voltages while another section of the panel is being simultaneously sustained. A section is defined as a predetermined number of bulk sustain electrodes x and row scan electrodes y. In a surface discharge display, a single row is comprised of one pair of parallel top electrodes x and y.

In accordance with one embodiment and practice of the SAS architecture, there is provided the simultaneous addressing and sustaining of at least two sections $S_1$ and $S_2$ of a surface discharge PDP having a row scan, bulk sustain, and data electrodes, which comprises addressing one section $S_1$ of the PDP while a sustaining voltage is being simultaneously applied to at least one other section $S_2$ of the PDP.

In another SAS embodiment, the simultaneous addressing and sustaining is interlaced whereby one pair of electrodes y and x are addressed without being sustained and an adjacent pair of electrodes y and x are simultaneously sustained without being addressed. This interlacing can be repeated throughout the display. In this embodiment, a section S is defined as one or more pairs of interlaced y and x electrodes.

In an SAS system with essentially binary weighted subfields, it has been observed that artifacts such as false contour and flicker may occur between the different sections S1 and S2. This is because in an essentially binary weighted system, the two sections S1 and S2 are sustained and addressed at different times and do not have balanced centers of light gravity or mass.

An improved picture may be obtained with SAS by using gamma corrected subfields with carefully timed sustains to balance the center of light gravity or mass between S1 and S2.

Automatic Power Level (APL) is a well-understood concept in the industry. The number of sustains are reduced when the picture has a heavy fill factor and increased when the picture has a sparse fill factor. Table I and Table II below show the subfield count for two extreme APLs to be applied to the two sections S1 and S2 during even and odd frames. Other APL values are possible. The Tables I and II illustrate the concept with 12 subfields although subfield numbers are possible including but not limited to 6, 7, 8, 9, 10, 11, 12, 13, and 14 or combinations of these.

TABLE I

| | Bright APL | | | |
|---|---|---|---|---|
| | Frame Odd | | Frame Even | |
| | S1 | S2 | S1 | S2 |
| SF1 | 6 | 3 | 3 | 6 |
| SF2 | 10 | 7 | 7 | 10 |
| SF3 | 19 | 14 | 14 | 19 |
| SF4 | 30 | 24 | 24 | 30 |
| SF5 | 44 | 36 | 36 | 44 |
| SF6 | 61 | 52 | 52 | 61 |
| SF7 | 81 | 71 | 71 | 81 |
| SF8 | 104 | 92 | 92 | 104 |
| SF9 | 131 | 117 | 117 | 131 |
| SF10 | 161 | 145 | 145 | 161 |
| SF11 | 194 | 177 | 177 | 194 |
| SF12 | 110 | 212 | 212 | 110 |
| total | 951 | 950 | 950 | 951 |

TABLE II

| | Dim APL | | | |
|---|---|---|---|---|
| | Frame Odd | | Frame Even | |
| | S1 | S2 | S1 | S2 |
| SF1 | 2 | 2 | 2 | 2 |
| SF2 | 2 | 2 | 2 | 2 |
| SF3 | 3 | 2 | 2 | 3 |
| SF4 | 5 | 4 | 4 | 5 |
| SF5 | 7 | 6 | 6 | 7 |
| SF6 | 10 | 9 | 9 | 10 |
| SF7 | 14 | 12 | 12 | 14 |
| SF8 | 18 | 16 | 16 | 18 |
| SF9 | 22 | 20 | 20 | 22 |
| SF10 | 27 | 25 | 25 | 27 |
| SF11 | 33 | 30 | 30 | 33 |
| SF12 | 19 | 36 | 36 | 19 |
| total | 162 | 164 | 164 | 162 |

In the preferred embodiment, a cell is selectively addressed only once per frame. Thus when 12 subfields (sf) are used, only 13 combinations of true gray scale are realized. In this case selective addressing may be made through a selective erase or a selective write. By applying gamma correction, error diffusion, and spatial and sequential dithering as described in this invention, flicker will be further eliminated, more apparent gray shades will be realized, and a large number of rows may be addressed in a single scan.

Figure 10:
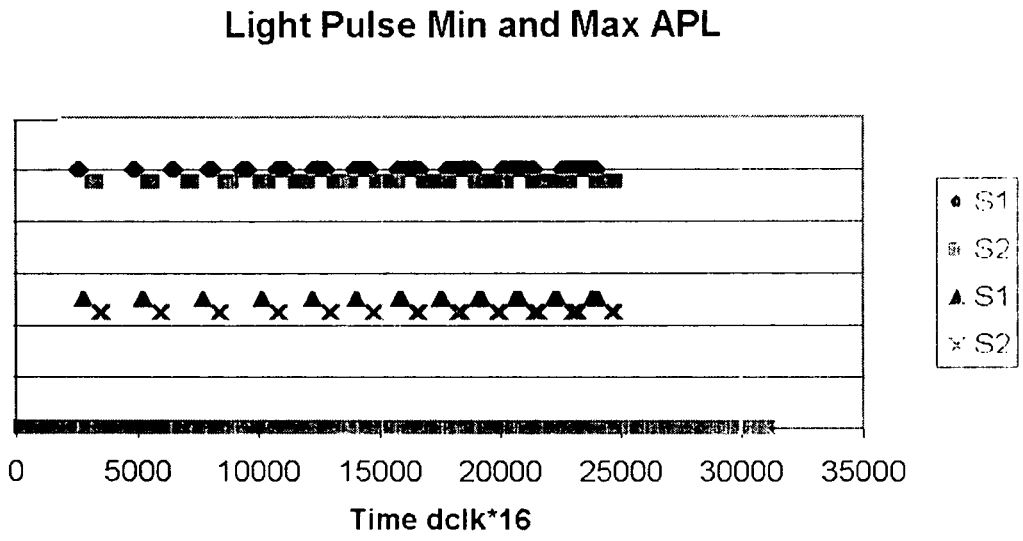
FIG. 10 is a scale drawing of a timing diagram for one frame that shows the relationship between sustains in alternate sections of the panel S1 and S2 for "Min" and "Max" APLs corresponding to "Bright" and "Dim".

FIG. 10 is a scale drawing of a timing diagram for one frame that shows the relationship between sustains in alternate sections of the panel S1 and S2 for Minimum (Min) and Maximum (Max) APLs corresponding to "Dim" and "Bright".

The Bright APLs are on top and the Dim APLs are on bottom. The unit dclock (dclk)=25 Mhz, which results in a frame rate of nominally 16.6 ms. Even with the large number of sustains (950) in the Bright APL, there is time to address the display in each subfield in accordance with SAS. In the preferred embodiment, this is done with selective erase. To further illustrate the center of light method, assume a given input luminance provided to a pixel in section S1 corresponds to 109 sustains out of a possible 951. During odd frames the pixel will be in the ON STATE for SF1 though SF5 for a total of 109 sustains. During even frames the pixel will alternately be on for SF1 through SF5 for a total of 84 sustains and SF1 through SF6 for a total of 136 sustains. The result is an average of 109 sustains. Although the number of sustains changes from frame to frame, the timing is such that the center of light gravity or mass does not change drastically from frame to frame. The average center of light gravity or mass is localized around a constant point and the sustains are averaged to the desired value consistent with the input luminance. A pixel in section S2 would receive the same values and the same average sustains except that it would be out of phase by one frame compared to a pixel in S1. The sustain order for this pixel would be 84-109-136-109 instead of 109-84-109-136.

PDP Structures

The artifact reduction method of this invention may be used with any suitable AC plasma display (PDP) structure. The PDP industry has used two basic PDP structures, the two-electrode columnar discharge structure and the three-electrode surface discharge structure.

The columnar discharge structure has been widely used in monochrome AC plasma displays that emit orange or red light from a neon gas discharge. Typically phosphors are not used in such monochrome structures. The two-electrode columnar discharge display structure is disclosed in U.S. Pat. No. 3,499,167 issued to Baker et al and U.S. Pat. No. 3,559,190 issued to Bitzer et al. The two-electrode columnar discharge structure is also referred to as opposing electrode discharge, twin substrate discharge, or co-planar discharge. In the two-electrode columnar discharge AC plasma display structure, the sustaining voltage is continuously applied between an electrode on a rear or bottom substrate and an opposite electrode on the front or top viewing substrate. The gas discharge takes place between the two opposing electrodes in between the top viewing substrate and the bottom substrate.

The present invention is described with reference to a surface discharge AC plasma display panel having a structure with three or more electrodes defining each pixel or cell. In a three-electrode surface discharge AC plasma display, a sustaining voltage is applied between a pair of adjacent parallel electrodes that are on the front or top viewing substrate. These parallel electrodes are called the bulk sustain electrode and the row scan electrode. The row scan electrode is also called a row sustain electrode because of its dual functions of address and sustain. The opposing electrode on the rear or bottom substrate is a column data electrode and is used to periodically address a row scan electrode on the top substrate. The sustaining voltage is applied to the bulk sustain and row scan electrodes on the top substrate. The gas discharge takes place between the row scan and bulk sustain electrodes on the top viewing substrate.

As disclosed and illustrated in Baker 167, the two-electrode columnar discharge AC plasma display panel is an opposing discharge display with the sustaining voltage being applied to the two opposing top and bottom electrodes. The discharge takes place between these two opposing electrodes and in between the opposing top and bottom substrates. In a multi-color columnar discharge PDP structure as disclosed in U.S. Pat. No. 5,793,158 issued to Donald K. Wedding, incorporated herein by reference, phosphor stripes or layers are deposited along the barrier walls on the bottom substrate adjacent to and extending in the same direction as the bottom electrode. The discharge between the two opposite electrodes generates electrons and ions that bombard and deteriorate the phosphor thereby shortening the life of the phosphor and the PDP.

In a three-electrode surface discharge AC plasma display panel, the sustaining voltage and resulting gas discharge occur between the electrode pairs on the top or front viewing substrate above and remote from the phosphor on the bottom substrate. This separation of the discharge from the phosphor prevents electron bombardment and deterioration of the phosphor deposited on the walls of the barriers or in the grooves (or channels) on the bottom substrate adjacent to and/or over the third (data) electrode. Because the phosphor is spaced from the discharge between the two electrodes on the top substrate, the phosphor is not subject to electron bombardment as in a columnar discharge PDP.

In a two electrode columnar discharge PDP as disclosed by Wedding 158, each light emitting pixel is defined by a gas discharge between a bottom or rear electrode x and a top or front opposite electrode y, each cross-over of the two opposing arrays of bottom electrodes x and top electrodes y defining a pixel or cell.

In a surface discharge PDP, each light emitting pixel or cell is defined by the gas discharge between two electrodes on the top substrate. In a multi-color RGB display, the pixels may be called sub-pixels or sub-cells. Photons from the discharge of an ionizable gas at each pixel or sub-pixel excite a photoluminescent phosphor that emits red, blue, or green light.

In the preferred practice and preferred embodiments of this invention, there is used a surface discharge PDP structure. The three-electrode multi-color surface discharge AC plasma panel structure is widely disclosed in the prior art including U.S. Pat. Nos. 5,661,500 and 5,674,553, both issued to Tsutae Shinoda et al of Fujitsu Limited; U.S. Pat. No. 5,745,086 issued to Larry F. Weber of Plasmaco and Matsushita; and U.S. Pat. No. 5,736,815 issued to Kimio Amemiya of Pioneer Electronic Corporation, all of which are incorporated herein by reference.

Surface discharge PDP also has manufacturing advantages over columnar discharge. For example, the deposition of phosphor in the manufacture of surface discharge is very forgiving because the phosphor covers the electrodes on the back (bottom) substrate without decreasing panel life.

In a columnar discharge PDP structure, the phosphor must be precisely deposited and cannot cover electrode discharge sites on the back substrate without further decreasing phosphor life. There is little or no forgiveness in deposition of the phosphor. It may also be necessary to use an overcoat such as magnesium oxide to protect the phosphor from discharge ion bombardment. However, a protective overcoat decreases light output from the phosphor. A protective phosphor overcoat is typically not required in the manufacture of a surface discharge display structure.

The surface discharge PDP structure is much less sensitive than columnar discharge to variations in the gas discharge gap between the back and front substrates. In a columnar discharge PDP structure, the gap must be precisely controlled to avoid variations and distortions in luminance and chromaticity.

The luminance (brightness) and contrast ratio are higher in a surface discharge and the power lower. This results in a much higher luminous efficiency for a surface discharge PDP than a columnar discharge PDP.

Single Plane PDP

The columnar discharge PDP or surface discharge PDP may be a single plane structure, also called a single substrate or monolithic structure. Examples of single plane PDPs are disclosed in U.S. Pat. No. 3,666,981 issued to Frank M. Lay of IBM, U.S. Pat. No. 3,811,061 issued to Narihiko Nakayama et al of Fujitsu, U.S. Pat. No. 3,860,846 issued to William N. Mayer of Control Data Corp, U.S. Pat. No. 3,885,195 issued to Yoshifumi Amano of Sony, U.S. Pat. Nos. 3,935,494 and 4,106,009 issued to George W. Dick et al of Bell Laboratories, and U.S. Pat. No. 4,164,678 issued to Martin R. Biazzo et al of Bell Laboratories, all of which are incorporated by reference.

Microspheres

The PDP may also be constructed of gas filled microspheres. Examples of PDP structures containing microspheres are disclosed in U.S. Pat. Nos. 2,644,113 (Etzkorn), 3,848,248 (Macintyre), 4,035,690 (Roeber), and 6,545,422 (George et al), all incorporated herein by reference. PDP structures with microspheres are also disclosed in co-pending US patent applications of Carol A. Wedding et al and are called Plasma-spheres™.

Tubes

The PDP may also be constructed of gas filled tubes. Examples of PDP structures containing tubes are disclosed in U.S. Pat. Nos. 3,602,754 (Pfaender et al), 3,654,680 (Bode et al), 3,969,718 (Strom), 3,990,068 (Mayer et al), 4,027,188 (Bergman), 5,984,747 (Bhagavatula et al), 6,255,777 (Kim et al), 6,545,422 (George et al) and US patent Application 2001/0028216 A1 (Tokai et al), all incorporated herein by reference. PDP structures with tubes are also disclosed in co-pending US patent applications of Carol A. Wedding, et al.

Electronic addressing of PDPs

In the preferred practice, the artifact reduction methods of this invention especially the center of mass method, are used with SAS architecture. However, this invention may be practiced with other suitable PDP electronics addressing schemes or electronics architecture. Examples of such addressing schemes and architectures are discussed below and include ADS, AWD, and MASS. In the preferred practice of this invention, there is used ADS or SAS with a surface discharge PDP. ADS or SAS are typically used in combination with slow ramp reset voltages, as discussed below.

Addressing of Columnar Discharge Structure

The prior art has disclosed addressing architectures for monochrome and multi-color columnar discharge PDP. The columnar discharge PDP is an opposite discharge two-electrode structure with an array of bottom electrodes x and an array of top opposite electrodes y, the crossover of each bottom x electrode and each top y electrode defining a cell or pixel. The sustaining voltage is applied to the opposite bottom electrode x and to the top electrode y with the gas discharge taking place between the bottom electrode x and top electrode y. Examples of addressing architectures for columnar discharge PDP are disclosed in U.S. Pat. No. 5,075,597, U.S. Pat. No. 5,828,356, and U.S. Pat. No. 6,191,763, all incorporated herein by reference.

ADS Addressing of Multi-Color Surface Discharge Structure

A basic electronics architecture for addressing and sustaining a surface discharge AC plasma display is called Address Display Separately (ADS). The ADS architecture is disclosed in a number of Fujitsu patents including U.S. Pat. Nos. 5,541,618 and 5,724,054, both issued to Shinoda of Fujitsu Ltd., Kawasaki, Japan and incorporated herein by reference. Also see U.S. Pat. No. 5,446,344 issued to Yoshikazu Kanazawa of Fujitsu, incorporated by reference, and Shinoda et al 500 referenced above. ADS has become a basic electronic architecture widely used in the AC plasma display industry with surface discharge PDP.

Fujitsu ADS architecture is commercially used by Fujitsu and is also widely used by competing manufacturers including Matsushita and others. ADS is disclosed in U.S. Pat. No. 5,745,086 issued to Weber of Plasmaco and Matsushita, incorporated by reference. See FIGS. 2, 3, 11 of Weber 086. The ADS method of addressing and sustaining a surface discharge display as disclosed in U.S. Pat. Nos. 5,541,618 and 5,724,054 issued to Shinoda of Fujitsu sustains the entire panel (all rows) after the addressing of the entire panel. Thus the addressing and sustaining are done separately and are not done simultaneously as in the practice of the SAS architecture.

AWD Addressing

Another architecture used in the prior art is called Address While Display (AWD). The AWD electronics architecture was first used during the 1970s and 1980s for addressing and sustaining monochrome PDP. In AWD architecture, the addressing (write and/or erase pulses) are interspersed with the sustain waveform and may include the incorporation of address pulses onto the sustain waveform. Such address pulses may be on top of the sustain and/or on a sustain notch or pedestal. See for example U.S. Pat. No. 3,801,861 issued to Petty et al and U.S. Pat. No. 3,803,449 issued to Schmersal. FIGS. 1 and 3 of the Shinoda 054 ADS patent discloses AWD architecture as prior art.

The prior art AWD electronics architecture for addressing and sustaining monochrome PDP has also been adopted for addressing and sustaining multi-color PDP. For example, Samsung Display Devices Co., Ltd., has disclosed AWD and the superimpose of address pulses with the sustain pulse. Samsung specifically labels this as address while display (AWD). See High-Luminance and High-Contrast HDTV PDP with Overlapping Driving Scheme, J. Ryeom et al, pages 743 to 746, Proceedings of the Sixth International Display Workshops, IDW 99, Dec. 1-3, 1999, Sendai, Japan. AWD is also disclosed in U.S. Pat. No. 6,208,081 issued to Yoon-Phil Eo and Jeong-duk Ryeom of Samsung, incorporated by reference.

LG Electronics Inc. has disclosed a variation of AWD with a Multiple Addressing in a Single Sustain (MASS) in U.S. Pat. No. 6,198,476 issued to Jin-Won Hong et al of LG Electronics, incorporated by reference. Also see U.S. Pat. No. 5,914,563 issued to Eun-Cheol Lee et al of LG Electronics, incorporated by reference.

Addressing of Surface Discharge Structure with SAS Architecture

SAS architecture comprises addressing one display section of a surface discharge PDP while another section of the PDP is being simultaneously sustained. This architecture is called Simultaneous Address and Sustain (SAS). In one preferred practice and embodiment, there is used a surface discharge PDP structure.

SAS offers a unique electronic architecture which is different from prior art columnar discharge and surface discharge electronics architectures including ADS, AWD, and MASS. It offers important advantages as discussed herein.

In accordance with the practice of SAS with a surface discharge PDP, addressing voltage waveforms are applied to a surface discharge PDP having an array of data electrodes on a bottom or rear substrate and an array of at least two electrodes on a top or front viewing substrate, one top electrode being a bulk sustain electrode x and the other top electrode being a row scan electrode y. The row scan electrode y may also be called a row sustain electrode because it performs the dual functions of both addressing and sustaining.

An important feature and advantage of SAS is that it allows selectively addressing of one section of a surface discharge PDP with selective write and/or selective erase voltages while another section of the panel is being simultaneously sustained. A section is defined as a predetermined number of bulk sustain electrodes x and row scan electrodes y. In a surface discharge PDP, a single row is comprised of one pair of parallel top electrodes x and y.

In one embodiment of SAS, there is provided the simultaneous addressing and sustaining of at least two sections $S_1$ and $S_2$ of a surface discharge PDP having a row scan, bulk sustain, and data electrodes, which comprises addressing one section $S_1$ of the PDP while a sustaining voltage is being simultaneously applied to at least one other section $S_2$ of the PDP.

In another embodiment, the simultaneous addressing and sustaining is interlaced whereby one pair of electrodes y and x are addressed without being sustained and an adjacent pair of electrodes y and x are simultaneously sustained without being addressed. This interlacing can be repeated throughout the display. In this embodiment, a section S is defined as one or more pairs of interlaced y and x electrodes.

In the practice of SAS, the row scan and bulk sustain electrodes of one section that is being sustained may have a reference voltage which is offset from the voltages applied to the data electrodes for the addressing of another section such that the addressing does not electrically interact with the row scan and bulk sustain electrodes of the section which is being sustained.

In a plasma display in which gray scale is realized through time multiplexing, a frame or a field of picture data is divided into subfields. Each subfield is typically composed of a reset period, an addressing period, and a number of sustains. The number of sustains in a subfield corresponds to a specific gray scale weight. Pixels that are selected to be "on" in a given subfield will be illuminated proportionally to the number of sustains in the subfield. In the course of one frame, pixels may be selected to be "on" or "off" for the various subfields. A gray scale image is realized by integrating in time the various "on" and "off" pixels of each of the subfields.

Addressing is the selective application of data to individual pixels. It includes the writing or erasing of individual pixels.

Reset is a voltage pulse which forms wall charges to enhance the addressing of a pixel. It can be of various waveform shapes and voltage amplitudes including fast or slow rise time voltage ramps and exponential voltage pulses. A reset is typically used at the start of a frame before the addressing of a section. A reset may also be used before the addressing period of a subsequent subfield.

In accordance with a further embodiment of the SAS architecture, there is applied a slow rise time or slow ramp reset voltage. As used herein "slow rise time or slow ramp voltage" is a bulk address commonly called a reset pulse with a positive or negative slope so as to provide a uniform wall charge at all pixels in the PDP.

The slower the rise time of the reset ramp, the less visible the light or background glow from those off-pixels (not in the on-state) during the slow ramp bulk address.

Less background glow is particularly desirable for increasing the contrast ratio which is inversely proportional to the light-output from the off pixels during the reset pulse. Those off-pixels which are not in the on-state will give a background glow during the reset. The slower the ramp, the less light output with a resulting higher contrast ratio. Typically the "slow ramp reset voltages" disclosed in the prior art have a slope of about 3.5 volts per microsecond with a range of about 2 to about 9 volts per microsecond.

In the SAS architecture, it is possible to use "slow ramp reset voltages" below 2 volts per microsecond, for example about 1 to 1.5 volts per microsecond without decreasing the number of PDP rows, without decreasing the number of sustain pulses or without decreasing the number of subfields.

Slow Ramp Reset Voltage

This invention may be practiced with slow ramp reset voltages. In one embodiment there is used ADS with slow ramp reset. In another embodiment, there is used SAS with slow ramp reset.

The prior art discloses slow rise slopes or ramps for the addressing of AC plasma displays. The early patents include U.S. Pat. Nos. 4,063,131 and 4,087,805 issued to John Miller of Owens-Ill.; U.S. Pat. No. 4,087,807 issued to Joseph Miavecz of Owens-Ill.; and U.S. Pat. Nos. 4,611,203 and 4,683,470 issued to Tony Criscimagna et al of IBM, all incorporated by reference.

An architecture for a slow ramp reset voltage is disclosed in U.S. Pat. No. 5,745,086 issued to Larry F. Weber of Plasmaco and Matsushita, incorporated by reference. Weber 086 discloses positive or negative ramp voltages that exhibit a slope that is set to assure that current flow through each display pixel site remains in a positive resistance region of the gas's discharge characteristics. The slow ramp architecture is disclosed in FIG. 11 of Weber 086 in combination with the Fujitsu ADS.

PCT Patent Application WO 00/30065 filed by Junichi Hibino et al of Matsushita also discloses architecture for a slow ramp reset voltage. Habino et al is incorporated by reference. This reference discloses a total ramp reset cycle time restricted to less than 360 microseconds for a display panel resolution up to 1080 row scan electrodes with a maximum of 8 subfields using dual scan. With dual scan, Habino et al can obtain up to 15 subfields for lower resolution displays such as 480 and 768 row scan electrodes.

The SAS architecture allows for a ramp reset cycle time up to 1000 microseconds (one millisecond) or more depending upon the PDP resolution. For a display panel resolution of 1080 row scan electrodes, the SAS architecture allows for a ramp reset cycle time up to 800 microseconds without decreasing the number of sustains and/or sub fields as required in the prior art.

For lower panel scan row resolutions of 480 and 768, SAS architecture allows a ramp reset cycle time up to 1000 microseconds.

Habino et al specifies a reset voltage rise slope of no more than 9 volts per microsecond. Because the entire reset cycle time of Habino et al. is a maximum of 360 microseconds, it is not feasible for Habino et al to use a reset ramp slope of 1.5 volts per microsecond without also decreasing the maximum or peak voltage amplitude of the reset voltage below the amplitude required for reliable discharge and stable addressing. The practice of the SAS architecture allows for the use of a reset ramp slope of 1 to 1.5 volts per microsecond at the maximum reset voltage amplitude required for reliable discharge and stable addressing.

The practice of the SAS architecture and invention also allows the use of a low reset voltage rise slope of about 1 to 1.5 volts per microsecond with an overall ramp reset cycle time up to 1000 microseconds.

In one embodiment of this invention practiced with SAS, there is used a ramp reset cycle time of 800 microseconds, a display resolution of 1080 row scan electrodes, and a reset voltage rise slope of 1 to 1.5 volts per micro second.

The resolutions typically contemplated in the practice of this invention are 480, 600, 768, 1024, 1080, and 1200 row scan electrodes which are currently used in the PDP industry. However, other resolutions may be used.

Advantages of SAS

SAS allows for simultaneous addressing and sustaining thereby providing more time within the frame for other waveform operations. By comparison the ADS architecture of Fujitsu allocates 75 percent of the frame time for addressing and 25 percent for sustaining.

Because both the addressing and sustaining are completed in 75 percent of the available frame time, SAS has 25% remaining frame time.

SAS has the ability to do 6 to 17 sub-fields for panel resolutions up to 768 row scan electrodes and 10 to 12 subfields for resolutions of 1080 row scan electrodes without using dual scan.

With SAS, the slow ramp reset can be tailored to ramp slopes of 1.5 microseconds per volt or less which greatly minimizes background glow. This is not possible with the ADS approach of Fujitsu. SAS also provides for a more uniform contrast ratio, better wall charge profile and improved addressing stability.

Dual Scan

In the practice of this invention the PDP may be physically divided into at least two sections with each section being addressed by separate electronics. This was first disclosed in U.S. Pat. Nos. 4,233,623 and 4,320,418 issued to Dr. Thomas J. Pavliscak, both incorporated by reference. It is also disclosed in U.S. Pat. No. 5,914,563 issued to Eun-Cheol Lee et al of LG Electronics, incorporated by reference.

In the PDP industry this dividing of the PDP into two sections with separate electronics for each section is called dual scan. It is more costly to use dual scan because of the added electronics and reduced PDP yield. However, dual scan has been necessary with ADS and AWD architecture in order to obtain sufficient sub-fields at higher resolutions. The practice of SAS architecture allows for a larger number of subfields at higher resolutions without using dual scan.

SAS maintains higher probability of priming particles due to its virtual "dual-scan" like operation.

Coupled with improved priming and uniform wall charge distribution, SAS allows for the addressing of high resolution AC plasma displays with 10 to 12 sub-fields at a high resolution of 1080 row scan electrodes without dual scan.

Figure 11:
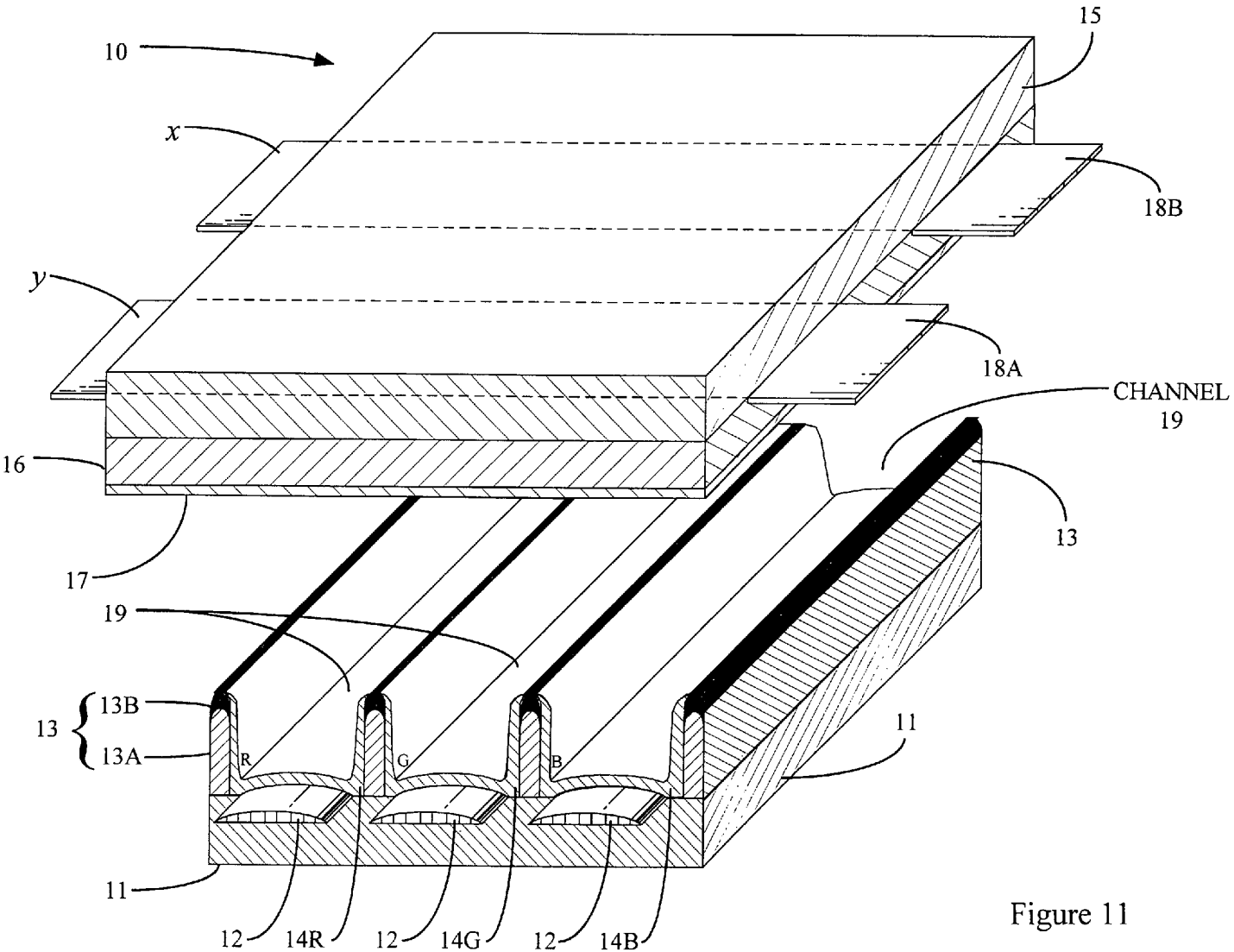
FIG. 11 shows a prospective view of an AC gas discharge plasma display panel (PDP) with a surface discharge structure.

Detailed Description of FIG. 11 and PDP Surface Discharge Structure

FIG. 11 shows an AC gas discharge PDP with a surface discharge structure 10 similar to the surface discharge structure illustrated and described in FIG. 2 of U.S. Pat. No. 5,661,500 (Shinoda et al.) which is cited above and incorporated herein by reference. The panel structure 10 has a bottom or rear glass substrate 11 with column data electrodes 12, barriers 13, and phosphor 14R, 14G, 14B.

Each barrier 13 comprises a bottom portion 13A and a top portion 13B. The top portion 13B is dark or black for increased contrast ratio. The bottom portion 13A may be translucent, opaque, dark, or black.

The top substrate 15 is transparent glass for viewing and contains y row scan (or sustain) electrodes 18A and x bulk sustain electrodes 18B, dielectric layer 16 covering the electrodes 18A and 18B, and a magnesium oxide layer 17 on the surface of dielectric 16. The magnesium oxide is for secondary electron emission and helps lower the overall operating voltage of the display.

A plurality of channels 19 are formed by the barriers 13 containing the phosphor 14. When the two substrates 11 and 15 are sealed together, an ionizable gas mixture is introduced into the channels 19. This is typically a Penning mixture of the rare gases. Such gases are well known in the manufacture and operation of gas discharge displays.

As noted above, each electrode 12 on the bottom substrate 11 is called a column data electrode. The y electrode 18A on the top substrate 15 is the row scan (or sustain) electrode and the x electrode 18B on the top substrate 15 is the bulk sustain electrode. A pixel or sub-pixel is defined by the three electrodes 12, 18A, and 18B. The gas discharge is initiated by voltages applied between a bottom column data electrode 12 and a top y row scan electrode 18A. The sustaining of the resulting discharge is done between an electrode pair of the top y row scan electrode 18A and a top x bulk sustain electrode 18B. Each pair of the y and x electrodes is a row.

Phosphor 14R emits red luminance when excited by photons from the gas discharge within the plasma panel. Phosphor 14G emits green luminance when excited by photons from the gas discharge within the plasma panel. Phosphor 14B emits blue luminance when excited by photons for the gas discharge within the plasma panel.

Although not illustrated in FIG. 11, the y row scan (or sustain) electrode 18A and the x bulk sustain electrode 18B may each be a transparent material such as tin oxide or indium tin oxide (ITO) with a conductive thin strip, ribbon or bus bar along one edge. The thin strip may be any conductive material including gold, silver, chrome-copper-chrome, or like material. Both pure metals and alloys may be used. This conductive strip is illustrated in FIG. 2 of Shinoda 500.

Split or divided electrodes connected by cross-overs may also be used for x and y for example as disclosed in U.S. Pat. No. 3,603,836 issued to John Grier, incorporated by reference. A split electrode structure may also be used for the column data electrodes.

The column data electrodes may be of different widths for each R, G, B phosphor as disclosed in U.S. Pat. No. 6,034,657 issued to Tokunaga et al of Pioneer, incorporated by reference.

The electrode arrays on either substrate are shown in FIG. 11 as orthogonal, but may be of any suitable pattern including zig-zag or serpentine.

Although the practice of this invention is described herein with each pixel or sub-pixel defined by a three-electrode surface discharge structure, it will be understood that this invention may also be used with surface discharge structures having more than three distinct electrodes, for example more than two distinct electrodes on the top substrate and/or more than one distinct electrode on the bottom substrate. In the literature, some surface discharge structures have been described with four or more electrodes including three or more electrodes on the front substrate.

ALIS

The prior art has also described surface discharge structures where there is a sharing of electrodes between pixels or sub-pixels on the front substrate. Fujitsu has described this structure in a paper by Kanazawa et al published on pages 154 to 157 of the 1999 *Digest of the Society for Information Display*, incorporated herein by reference. Fujitsu calls this "Alternating Lighting on Surfaces" or ALIS. This structure and the addressing architecture are disclosed in European Patent Application EP 0 945 975 A1 filed by Setoguchi et al of Fujitsu, incorporated herein by reference. Fujitsu has used ALIS with ADS. The ALIS shared electrodes structure and electronic processing methods may be used in the practice of the embodiments of the present invention.

Detailed Description of FIGS. 12 to 15 and SAS

Figure 12:
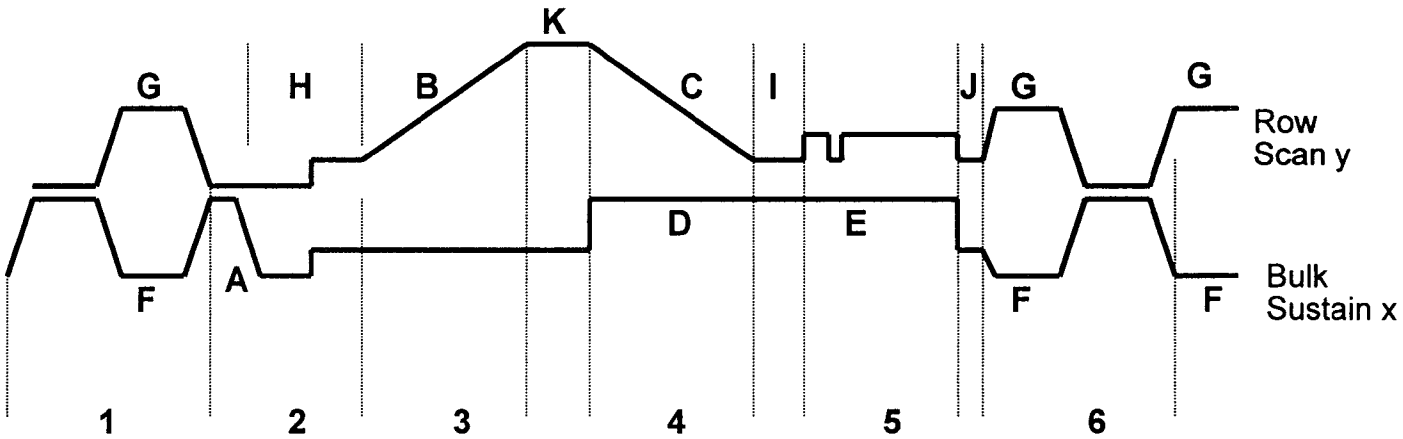
FIG. 12 shows a Simultaneous Address and Sustain (SAS) waveform.

FIG. 12 shows a Simultaneous Address and Sustain (SAS) waveform for the practice of SAS with a surface discharge AC plasma display, for example a PDP as illustrated in FIG. 11. FIG. 12 shows SAS waveforms with Phases 1, 2, 3, 4, 5, 6 for the top row scan electrode y and the top bulk sustain electrode x. In FIG. 12, the scan row electrode y corresponds to electrode 18A in FIG. 11. The bulk sustain electrode x corresponds to electrode 18B in FIG. 11.

Figure 13:
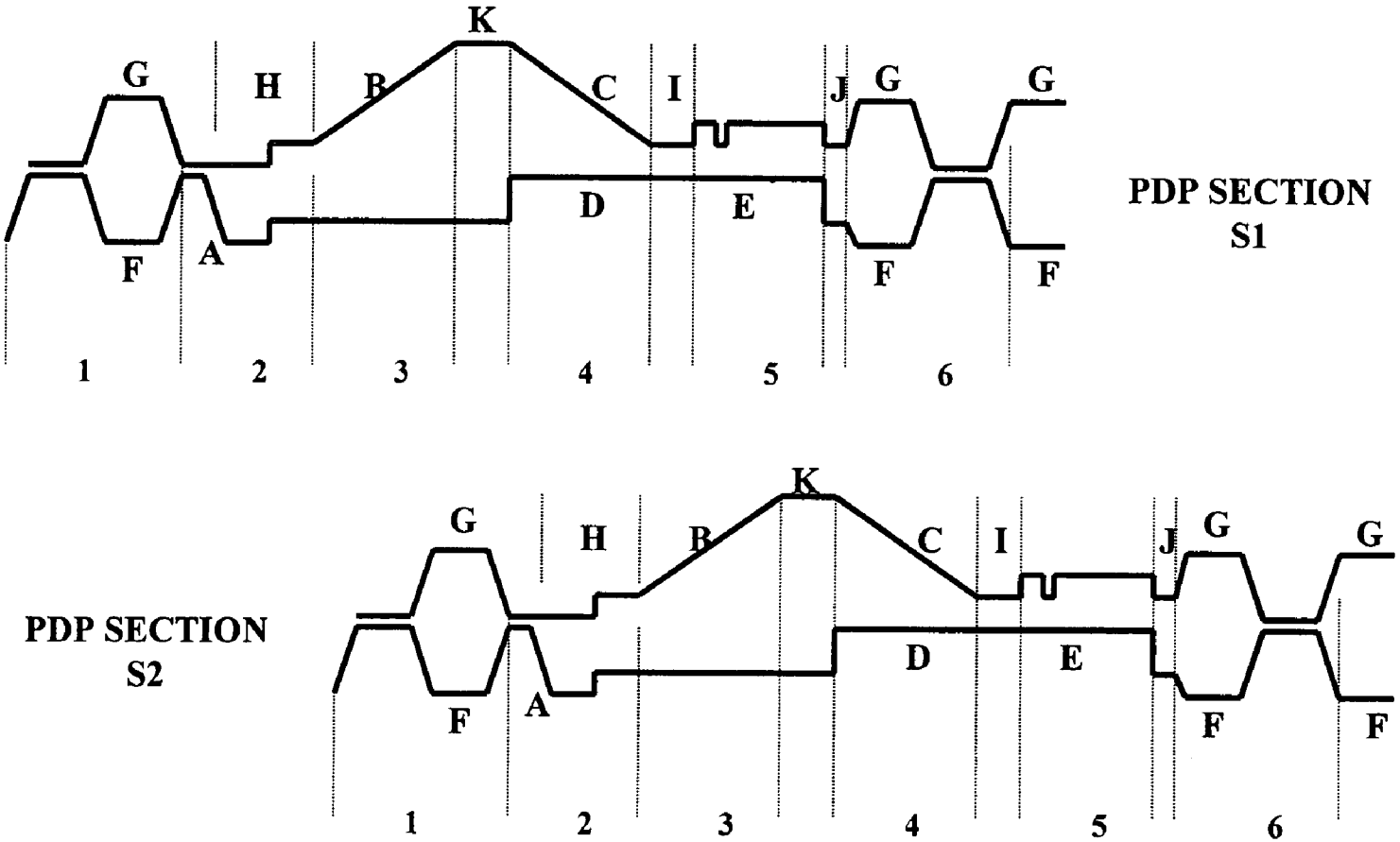
FIG. 13 shows an SAS waveform for simultaneous addressing and sustaining different sections $S_1$ and $S_2$ of a surface discharge PDP

In Phases 1 and 6 of FIG. 12 the sustaining pulse for the electrodes x and y is shown. The data electrode CD (element 12 in FIG. 11) is simultaneously addressing another section of the display as shown in FIG. 13 which is not being sustained. In the Fujitsu ADS architecture the bottom column data electrode CD is positively offset during sustain, and simultaneous operations are not allowed.

Phase 2 of FIG. 12 is the priming phase for the up ramp reset. A reset pulse conditions both the on and off pixels to the same wall charge. It provides a uniform wall charge to all pixels. A is a sustain pulse that is narrower in length than the previous sustain pulses. Its function is to sustain the on pixels and immediately extinguish them. It is sufficiently narrow (typically 1 microsecond or less) to prevent wall charges from accumulating. This narrow pulse causes a weak discharge and may be at higher voltages relative to other sustain pulses in the system. Alternately, a wider pulse with a lower voltage than "G" may be used.

As illustrated in FIG. 12, G is the highest and most positive amplitude of the sustain. F is the lowest and most negative amplitude of the sustain.

H is a period of time sufficient to allow the ramp to take advantage of the priming caused by the narrow sustain pulse and erase.

At the end of Phase 2 the row scan electrode y and bulk sustain electrode x go back to reference. This can also occur at the end of Phase 4 and the beginning of Phase 5, but such requires additional circuitry and adds to the cost of the system.

Phase 3 of FIG. 12 is the up ramp reset. Because of the SAS architecture, B can be made to ramp slower than prior art architecture (without implementing dual scan). This allows for uniform wall charge deposition. It also reduces background glow and increases the addressing voltage window. K is the idle time before negative ramp reset.

Phase 4 of FIG. 12 is the down ramp reset. If necessary, C and D may be combined to provide a weak discharge. If the up ramp B is slow enough, D may not be needed and C can have an RC slope, where R is the resistance of the electronic circuitry and C is the capacitance of the AC plasma display panel. A weak discharge caused by B or the combination of C and D will further insure a uniform wall charge profile for the various pixel or sub-pixel sites. I is the idle time before addressing.

Phase 5 of FIG. 12 shows the addressing of the row scan electrode y. The row addressing voltage is at an amplitude level sufficiently high to preserve the negative wall charge put on the pixel by the reset pulses of Phases 3 and 4. The row scan electrode y is selectively adjusted so that it may be selectively addressed by the bottom column data electrode CD. J is the idle time before sustaining.

The bulk sustain electrode x has a positive voltage applied throughout the addressing phase to induce charge transport between the pair of electrodes x and y which are sustained after the addressing discharge has taken place.

FIG. 13 shows the SAS waveform of FIG. 12 being used to address and sustain different Sections S1 and S2 of a surface discharge AC plasma display. The waveform for S1 is simultaneously addressing while the waveform for S2 is sustaining. Each waveform for the two Sections S1 and S2, is a repeat of the SAS waveform described in FIG. 12, but each is out of phase with respect to the other as illustrated in FIG. 13.

Figure 14:
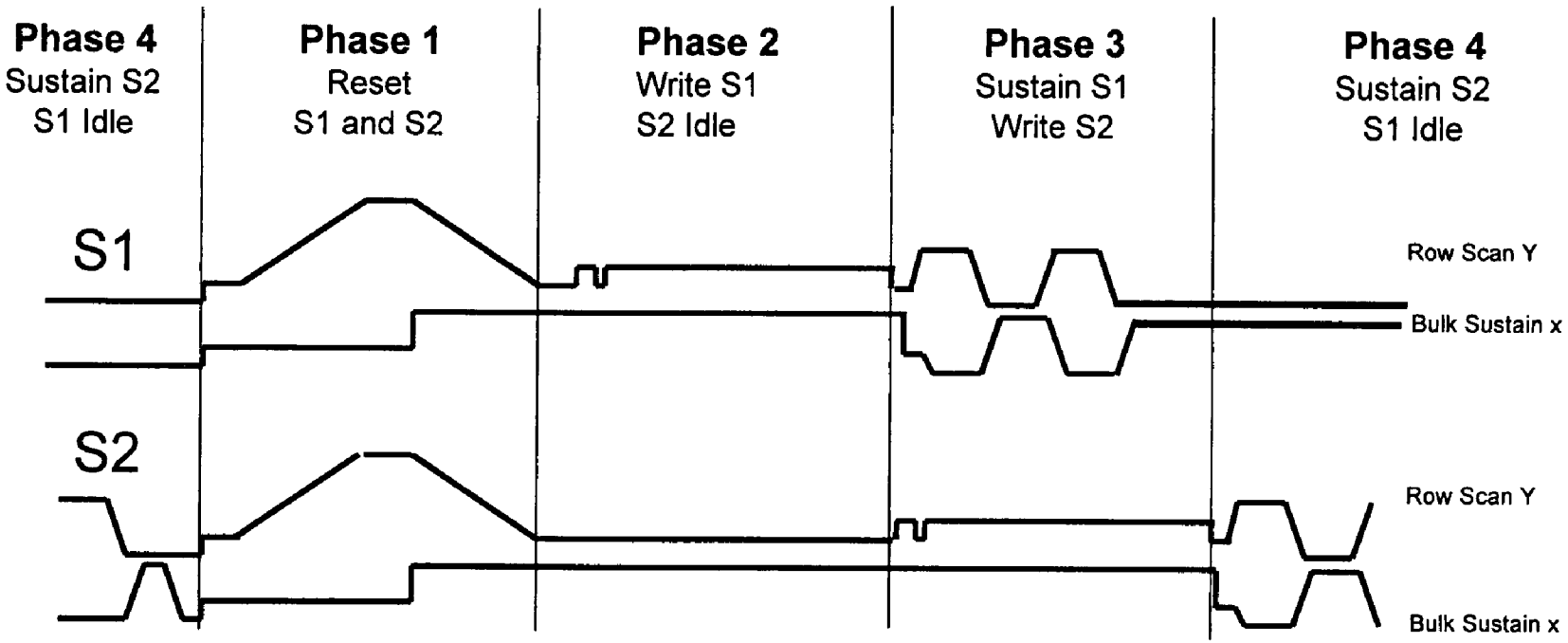
FIG. 14 shows another SAS waveform for simultaneous addressing and sustaining different sections $S_1$ and $S_2$ of a surface discharge PDP.

The waveform of FIG. 14 may also be used for addressing one section $S_1$ while another section $S_2$ is simultaneously being sustained. The sections $S_1$ and $S_2$ may be sustained with the same number of sustains per subfield or with a different number of sustains per subfield.

In Table III there is presented a 10 subfield example using the waveform of FIG. 14 with the same number of sustains in each subfield for Section 1 and Section 2.

TABLE III

| Subfield | 1 | 2 | 3 | 4 | 5 | 6 | 7 | 8 | 9 | 10 |
|---|---|---|---|---|---|---|---|---|---|---|
| # sustains $S_1$ | 96 | 96 | 96 | 96 | 64 | 32 | 16 | 8 | 4 | 2 |
| # sustains $S_2$ | 96 | 96 | 96 | 96 | 64 | 32 | 16 | 8 | 4 | 2 |

Table IV shows one subfield within the frame.

TABLE IV

| Subfield | 1 | | | |
|---|---|---|---|---|
| $S_1$ | Reset | Address | 96 Sustain | |
| $S_2$ | Reset | | Address | 96 Sustain |

Table V shows 10 subfields with a different number of sustains in each subfield for $S_1$ and $S_2$

TABLE V

| Subfield | 1 | 2 | 3 | 4 | 5 | 6 | 7 | 8 | 9 | 10 |
|---|---|---|---|---|---|---|---|---|---|---|
| # sustains $S_1$ | 96 | 96 | 96 | 96 | 64 | 32 | 16 | 8 | 4 | 2 |
| # sustains $S_2$ | 2 | 4 | 8 | 16 | 32 | 64 | 96 | 96 | 96 | 96 |

Table VI shows one subfield within the frame.

TABLE VI

| Subfield | 1 | | | |
|---|---|---|---|---|
| $S_1$ | Reset | Address | 96 Sustain | |
| $S_2$ | Reset | | Address | 2 Sustain |

In the case of different sustains being employed by $S_1$ and $S_2$, an additional advantage may be derived by changing the order in which $S_1$ and $S_2$ are addressed. Additional time savings may also be obtained if the section with the larger number of sustains is addressed in phase 2. This allows for a greatest amount of overlap to occur between sustaining and addressing in Phase 3. The result is more time available for ramped resets, additional sustains, additional subfields, and/or more rows.

Figure 15:
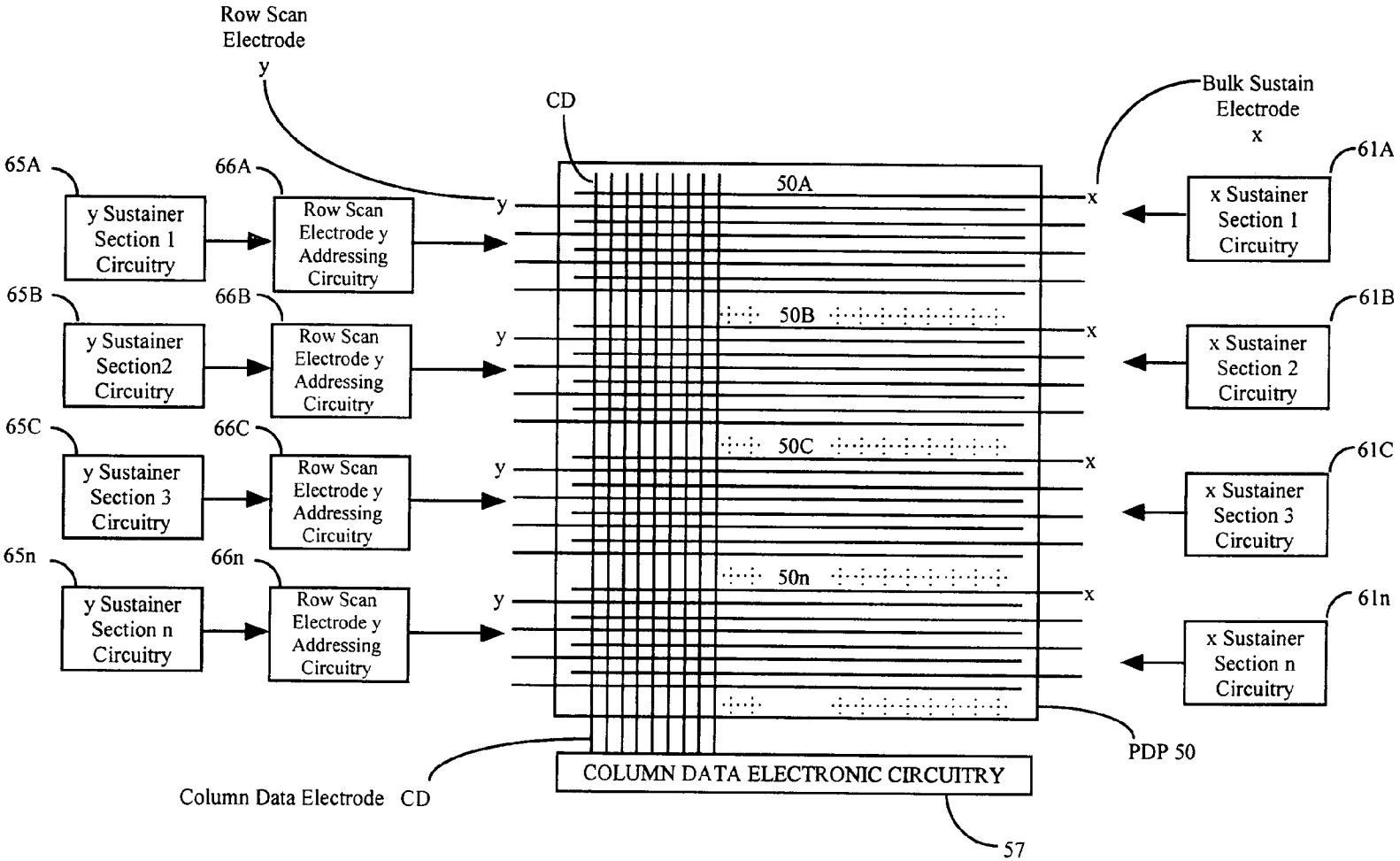
FIG. 15 shows an SAS electronic circuitry diagram for simultaneous address and a sustain of different sections of a surface discharge PDP.

The waveforms of FIGS. 12, 13, and 14 may be implemented with the Block Diagram Circuitry of FIG. 15.

FIG. 15 is an electronics circuitry block diagram for Simultaneous Address and Sustain (SAS) of a surface discharge AC plasma display such as shown in FIG. 11. This shows the practice of this invention on a surface discharge AC plasma display panel (PDP) 50 subdivided into n sections 50A, 50B, 50C, 50*n*. As shown in FIG. 15, each section has at least four pairs of parallel top electrodes y and x where y is the row scan electrode and x is the bulk sustain electrode. Although each section of the PDP in FIG. 15 is shown with four pairs of parallel top electrodes y and x, each section may contain more than four pairs. Also the sections are typically without blank spacing between sections as shown in FIG. 15. The blank spacing is used to illustrate that the sections are separate and distinct. Each PDP section in FIG. 15 also has a number of Column Data Electrodes CD, which are connected to Column Data Electronic Circuitry 57. The CD electrodes are the same as the electrodes 12 in FIG. 11. The electrodes x and y are the same as electrodes 18B and 18A, respectively, in FIG. 11.

FIG. 15 shows an embodiment in which y Addressing Circuitry and y Sustainer Circuitry for the Row Scan electrodes y is separately provided for each of the Sections 50A, 50B, 50C, and 50*n*. Addressing Circuitry 66A and y Sustain Section I Circuitry 65A are connected to the Scan Electrodes y of Section 50A. The x Sustainer Section I Circuitry 61A is connected to the Sustain Electrode x of Section 50A. This address and sustain circuitry is repeated for y and x for Sections 50 B, 50C and 50*n*. The y Addressing Circuitry and y Sustain Circuitry of each section works with the x Sustain Circuitry of each section to address and sustain each unique section of the PDP 50. In FIG. 15 this uniquely addressable portion is labeled Section 50A, 50B, 50C, 50*n*, each being comprised of one or more y scan electrode-x sustain electrode pairs. FIG. 15 shows an embodiment in which pairs of y scan electrode-x sustain electrodes of a given section are adjacent to each other on the PDP. This method will also work if scan electrode-sustain electrode pairs of a given section are not adjacent to each other, but are interlaced throughout the display.

The SAS architecture allows for a larger number of sustain cycles per frame. This allows for a brighter display or alternatively more subfields per display. This also improves the PDP operating margin (window) due to more time allowed for the various overhead functions.

In the practice of this invention, the center of light gravity or mass artifact reduction methods of this invention may be used alone or in combination with other artifact reduction methods with the SAS architecture for the reduction of visual artifacts including static and dynamic contour between two PDP sections being simultaneously addressed and sustained. These other artifact reduction methods include gamma correction, error diffusion, and dithering as described herein.

In the practice of this invention, the artifact reduction methods of this invention may also be used with ADS or other addressing architectures for the reduction of visual artifacts including static and dynamic contour. Thus the artifact reduction methods of this invention including gamma correction, error diffusion, dithering, and center of light may be used alone or in combination (and/or with other methods) for reducing artifacts in ADS or other addressing architectures and PDP structures including ALIS.

In the practice of this invention, an integrated circuit may be utilized to perform one or more of the artifact reduction methods and/or to perform timing control methods. Such integrated circuit(s) may comprise a monolithic structure which receives and processes digital signals (input luminance). The processing may comprise one or more artifact reduction methods such as described herein including gamma correction, error diffusion, and dithering. Timing methods such as center of light may be included in the same or a separate integrated circuit.

In one embodiment, an integrated circuit is used to perform the SAS and center of light methods for the timing functions and control.

As disclosed herein, this invention is not to be limited to the exact forms shown and described. Changes and modifications may be made by one skilled in the art within the scope of the following claims.

The invention claimed is:

1. In a method for addressing and sustaining a PDP wherein an addressing voltage is applied to at least one section S1 of the PDP while at least one other section S2 of the PDP is being simultaneously sustained, the improvement wherein visual artifacts between the sections are reduced by means of gamma corrected subfields with sustains timed to balance the center of light between S1 and S2.

2. In a method for operating a surface discharge AC plasma display having row scan, bulk sustain, and column data electrodes, the improvement which comprises addressing at least one section $S_1$ of the AC plasma display while another section $S_2$ is being simultaneously sustained, each section having a predetermined number of bulk sustain electrodes and row scan electrodes, and wherein visual artifacts between the sections are reduced by means of gamma corrected subfields with sustains timed to balance the center of light between S1 and S2.

3. The invention of claim 2 wherein section $S_2$ is subsequently addressed while section $S_1$ is being sustained.

4. The invention of claim 3 wherein there are 6 to 17 subfields.

5. The invention of claim 4 wherein each of the sections $S_1$ and $S_2$ is sustained with a different number of sustains per subfield.

6. The invention of claim 4 wherein at least one subfield of each section S1 and S2 is sustained with the same number of sustains per subfield.

7. The invention of claim 2 wherein the resolution of the plasma display is about 480 to about 1200 row scan electrodes.

8. The invention of claim 2 wherein there are 6 to 17 subfields for a resolution up to 768 row scan electrodes.

9. The invention of claim 2 wherein the method for the reduction of motion and visual artifacts includes the writing of pixels followed by selective erase.

10. The invention of claim 1 wherein there is provided a reset voltage before addressing.

11. The invention of claim 10 wherein the reset before addressing is a slow ramp reset voltage.

12. An AC plasma display having row scan, bulk sustain, and column data electrodes, said display being divided into a plurality of sections $S_1$, $S_2$, $S_n$, each section having a predetermined number of bulk sustain electrodes and row scan electrodes, and electronic circuitry for simultaneously addressing and sustaining at least two different sections of the AC plasma display, the improvement wherein visual artifacts between a section being addressed and a section being simultaneously sustained are reduced by means of gamma corrected subfields with sustains timed to balance the center of light between the sections.

13. The invention of claim 12 wherein there is provided a reset voltage before addressing.

14. The invention of claim 13 wherein the reset before addressing is a slow ramp reset voltage.

15. In a system for addressing and sustaining PDP, wherein an addressing voltage is applied to at least one section S1 of the display panel while at least one other section S2 of the panel is being simultaneously sustained, the improvement wherein visual artifacts are reduced by means of gamma corrected subfields with sustains timed to balance the center of light between S1 and S2.

16. In a system having electronic circuitry for operation of an AC plasma display having row scan, bulk sustain, and column data electrodes, said display being divided into a plurality of sections $S_1$, $S_2$, $S_n$, each section having a predetermined number of bulk sustain electrodes and row scan electrodes the improvement which comprises electronic circuitry for simultaneously addressing and sustaining at least two different sections of the AC plasma display and wherein visual artifacts between a section being addressed and a section being simultaneously sustained are reduced by means of gamma corrected subfields with sustains timed to balance the center of light between the sections.

17. The invention of claim 16 wherein there is provided a reset voltage before addressing.

18. The invention of claim 17 wherein the reset before addressing is a slow ramp reset voltage.

* * * * *